US008401865B2

(12) United States Patent
Ojala et al.

(10) Patent No.: US 8,401,865 B2
(45) Date of Patent: Mar. 19, 2013

(54) FLEXIBLE PARAMETER UPDATE IN AUDIO/SPEECH CODED SIGNALS

(75) Inventors: Pasi Sakari Ojala, Kirkkonummi (FI); Ari Kalevi Lakaniemi, Helsinki (FI)

(73) Assignee: Nokia Corporation, Espoo (FI)

( * ) Notice: Subject to any disclaimer, the term of this patent is extended or adjusted under 35 U.S.C. 154(b) by 329 days.

(21) Appl. No.: 12/665,549

(22) PCT Filed: Jul. 18, 2007

(86) PCT No.: PCT/IB2007/052866

§ 371 (c)(1),
(2), (4) Date: Dec. 18, 2009

(87) PCT Pub. No.: WO2009/010831

PCT Pub. Date: Jan. 22, 2009

(65) Prior Publication Data

US 2011/0077945 A1 Mar. 31, 2011

(51) Int. Cl.
*G10L 21/04* (2006.01)

(52) U.S. Cl. ..... 704/504; 704/278; 704/500; 704/501; 704/502; 704/503

(58) Field of Classification Search ..... 704/278, 704/500–504

See application file for complete search history.

(56) References Cited

U.S. PATENT DOCUMENTS

| | | | | |
|---|---|---|---|---|
| 7,337,108 | B2 * | 2/2008 | Florencio et al. | 704/208 |
| 7,664,650 | B2 * | 2/2010 | Endo et al. | 704/278 |
| 7,711,555 | B2 * | 5/2010 | Suzuki | 704/211 |
| 2006/0020318 | A1 | 1/2006 | Lenarz | |
| 2006/0050743 | A1 | 3/2006 | Black | |
| 2006/0206318 | A1 * | 9/2006 | Kapoor et al. | 704/221 |
| 2006/0271374 | A1 * | 11/2006 | Suzuki | 704/500 |

FOREIGN PATENT DOCUMENTS

| | | | |
|---|---|---|---|
| EP | 0751493 | A | 1/1997 |
| WO | 2005/073958 | A | 8/2005 |
| WO | 2006/099529 | A1 | 9/2006 |

OTHER PUBLICATIONS

Levine, S., "Audio Representation for Data Compression and Compressed Domain Processing", PHD Thesis, Stanford University, Dec. 1998, pp. 32-33, 70, 104-105 and 108-113.*

International Search Report and Written Opinion received in corresponding Patent Cooperation Treaty Application No. PCT/IB2007/052866, Mar. 17, 2008, 9 pages.

Antti Pasanen, "Coded Domain Level Control for the AMR Speech Codec", Nokia Research Center, (2006), (pp. I-685-I-688).

* cited by examiner

*Primary Examiner* — Douglas Godbold
(74) *Attorney, Agent, or Firm* — Harrington & Smith

(57) ABSTRACT

This invention relates to a method, a computer program product, apparatuses and a system for extracting coded parameter set from an encoded audio/speech stream, said audio/speech stream being distributed to a sequence of packets, and generating a time scaled encoded audio/speech stream in the parameter coded domain using said extracted coded parameter set.

19 Claims, 13 Drawing Sheets

FLEXIBLE PARAMETER UPDATE IN AUDIO/SPEECH CODED SIGNALS

RELATED APPLICATION

This application was originally filed as PCT Application No. PCT/IB2007/052866 filed Jul. 18, 2007.

FIELD OF THE INVENTION

This invention relates a method, a computer program product, apparatuses and a system for processing coded audio/speech streams.

BACKGROUND OF THE INVENTION

Network jitter and packet loss conditions can cause a degradation in quality for conversational audio service in packet switched networks, such as the Internet. The nature of the packet switched communications typically introduces variation in transmission of times of the packets, known as jitter, which is seen by the receiver as packets transmitted at regular intervals arriving at irregular intervals. On the other hand, an audio playback device requires that a constant input is maintained with no interruptions in order to ensure good sound quality. Thus, if some packets arrive after they are needed for decoding and playback, the decoder is forced to consider those packets as lost and to perform error concealment.

Typically a jitter buffer is utilized to store incoming frames for short period of time (e.g. by applying a predetermined buffering delay for the first packet of a stream) to hide the irregular arrival times and provide constant input to the decoder and audio playback device. However, jitter buffers typically store a number of received packets before the decoding process. This introduces an additional delay component and thereby increases the overall end to end delay in the communication chain. Such buffering can be characterized by the (average) buffering delay and the resulting proportion of delayed frames.

A shortcoming of this basic approach is that a jitter buffer with fixed playback timing (i.e. fixed buffer) is inevitably a compromise between low enough buffering delay and low enough number of delayed frames, and finding an optimal trade off is not a trivial task. Although there can be special environments and applications where the amount of expected jitter can be estimated to remain between predetermined limits. However, in general the network delay asscociated with jitter may vary from a scintilla of time to hundreds of milliseconds, even within the same session. Therefore, even in cases where the properties of the transmission channel are well known, it is generally not possible to set the initial buffering delay (applied for the first frame of a session) in such a way that the buffering performance throughout the session is optmised. This implies that using a fixed buffer with the initial buffering delay which is set to large enough value to cover the jitter according to expected worst case scenario would keep the number of delayed packets in control, however at the same time there is a risk of introducing end-to-end delay that is too long to enable a natural conversation. Therefore, applying a fixed buffer is far from optimal in most audio transmission applications operating over a packet switched network. For example, FIG. 1*a* depicts a situation where a fixed buffer is applied. Since the initial buffering delay was selected to be too small, frames 101,102 arrive after they are needed for further processing (e.g. playback or transmission further) and are therefore lost due to late arrival.

An adaptive jitter buffer can be used to dynamically control the balance between short enough delay and low enough number of delayed frames. In this approach the entity controlling the buffer constantly monitors the incoming packet stream and adjusts the buffering delay according to observed changes in the delay behaviour. If the transmission delay appears to increase or the jitter condition deteriorates, the buffering can be increased to meet the prevailing network conditions. In the opposite situation, where the network jitter condition improves, the buffering delay can be reduced, and hence, the overall end-to-end delay can be minimised.

Since the audio playback device typically needs regular input, buffer adjustment is not a straightforward task. A problem arises from the fact that if the buffering is reduced, the audio signal given to the playback device needs to be shortened to compensate the shortened buffering, and vice versa for the case of increasing the buffering a segment of audio signal needs to be inserted.

Prior-art methods for modifying the signal when increasing or decreasing the buffer may typically consist of repeating or discarding comfort noise signal frames within the buffer between active speech bursts. Further, advanced solutions may involve to operating during active speech regions utilizing signal time scaling in time-domain either inside the decoder or as a post-processing stage after the decoder in order to change the length of the output audio. In this approach, the buffer size is reduced when frames are temporarily retrieved more frequently due to faster play out. On the other hand, buffer size is increased when frame play out is temporarily slowed down.

The challenge in time scale modification during active signal content is to keep the perceived audio quality at a good enough level. Pitch-synchronous mechanisms, such as Pitch Synchronous Overlap-Add (PSOLA)—are typically used to provide time scale modifications with good voice quality at relatively low complexity. In practice this usually means either repeating or removing full pitch periods of signal and 'smoothing' the point of discontinuity to hide the possible quality effect caused by the time scale modifications, as exemplarily depicted in FIGS. 1*b*, 1*c* and 1*d*. Synchronous methods provide good results when used with monophonic and quasi-periodic signals, such as speech. An especially favourable approach to providing high-quality time scaling capability is to combine a pitch-synchronous scaling technique with the speech decoder. For example when used in conjunction with speech codecs such as Adaptive Multi-Rate (AMR), provides clear benefits in terms of low processing loads.

The described time scaling method to enable variable speech and audio playback for jitter buffer management is mainly for the terminal and transcoder equipment. That is, to be able to perform the time scaling operation on a sample by sample basis in time-domain, the (decoded) time-domain signal needs to be available. However, in case the IP transport terminates without transcoding, e.g. in transcoder free operation (TrFo) or tandem free operation (TFO) in a media gateway (MGW) or a terminal equipment, time scaling on sample basis cannot be utilized. A MGW or a terminal without transcoding can only adapt on a frame basis, i.e. inserting concealment frames or dropping frames, preferably during comfort noise periods. This results in decreased flexibility of the jitter buffer adaptation scheme, and also time based scaling during active speech is not possible without severe risk of voice quality distortion.

SUMMARY

This invention proceeds from the consideration that it is desirable to be able to conduct sample based time scaling without the need to perform transcoding.

It is thus, inter alia, an object of the present invention to provide a method, a computer-readable medium, a computer program, an apparatus and a system for enabling enhanced time scaling for encoded audio/speech streams.

According to a first aspect of the present invention, a method is described, comprising extracting a coded parameter set from an encoded audio/speech stream, said audio/speech stream being distributed to a sequence of packets, and generating a time scaled encoded audio/speech stream in the parameter coded domain using said extracted coded parameter set.

According to a second aspect of the present invention, a computer-readable medium having a computer program stored thereon is described, the computer program comprising instructions operable to cause a processor to extract a coded parameter set from an encoded audio/speech stream, said audio/speech stream being distributed to a sequence of packets, and instructions operable to cause a processor to generate a time scaled encoded audio/speech stream in the parameter coded domain using said extracted coded parameter set.

According to a third aspect of the present invention, a computer program is described, comprising instructions operable to cause a processor to extract a coded parameter set from an encoded audio/speech stream, said audio/speech stream being distributed to a sequence of packets, and instructions operable to cause a processor to generate a time scaled encoded audio/speech stream in the parameter coded domain using said extracted coded parameter set.

According to a fourth aspect of the present invention, an apparatus is described, comprising a processor configured to extract a coded parameter set from an encoded audio/speech stream, said audio/speech stream being distributed to a sequence of packets, and to generate a time scaled encoded audio/speech stream in the parameter coded domain using said extracted coded parameter set.

According to a fifth aspect of the present invention, an apparatus is described, comprising an extracting means for extracting a coded parameter set from an encoded audio/speech stream, said audio/speech stream being distributed to a sequence of packets, and means for generating a time scaled encoded audio/speech stream in the parameter coded domain using said extracted coded parameter set.

According to a sixth aspect of the present invention, a system is described, comprising a first network adapted to transmit encoded audio/speech streams, a second network adapted to transmit encoded audio/speech streams, a transmitter configured to provide an encoded audio/speech stream for transmission via said first network, and an apparatus as described above configured to receive said encoded audio/speech stream, to perform time scaling operation to said encoded audio/speech frame in said coded domain and to provide the encoded time scaled audio/speech frame for transmission via said second network.

Said audio/speech frame may be encoded with any speech of packet switched network codec, e.g. a Voice over IP coded, or with the 3GPP Adaptive Multi-Rate Wideband (AMR-WB) codec, or any other packet based codec, e.g. any other speech or audio codec like a Code Excited Linear Prediction (CELP) codecs or other frame based codecs.

Typical speech or audio encoders; e.g. a Code Excited Linear Prediction (CELP)-based speech encoder, such as the AMR family of coders, segments a speech signal in to frames, e.g. 20 msec in duration, and it may perform a further segmentation into subframes, e.g. twice or four time within a frame. Then a set of coded domain parameters may be computed, quantized, and transmitted to a receiver. This set of parameters may comprise a plurality of parameter types, e.g. a set of schematic Linear Predictive Coding (LPC) coefficients for a frame or subframe, a pitch value for a frame or subframe, a fixed codebook gain for a frame or subframe, an adaptive codebook gain for a frame or subframe, and/or a fixed codebook for a frame or subframe.

According to the present invention, a time scaling to at least one parameter of said parameter set of a speech/audio stream may be performed without performing a decoding operation, i.e. the time scaling is performed in a coded domain. Thus, a time scaling of a speech/audio signal associated with said speech/audio stream may be performed without transcoding the speech/audio signal.

For instance, this time scaling in the coded domain may be performed by means of any suited mathematical function in order to time scale at least one coded parameter of said parameter set according to a time shift value. For example, extrapolation or interpolation or a combination thereof may be used.

For instance, said coded domain time scaling may be used to enable an adaptive jitter buffer management, e.g. based on sample based accuracy. For example, said coded domain time scaling may be performed without changing the input stream rate and the output stream rate, and the decoded time domain output may simply be time scaled on sample basis compared to the input stream according to the time shift value.

Thus, for instance, the present invention may be used in a gateway in order to enable time scaling on sample based accuracy during active speech without the need of a transcoder, since decoding of the speech signal is not necessary to perform sample based time scaling due to performing time scaling in the coded domain according to the present invention.

According to an embodiment of the present invention, said parameter set comprises at least one coded parameter, and said at least one coded parameter is associated with at least one point in time, and at least one time scaled coded parameter is determined based on said at least one coded parameter and on a time shift value, wherein this determining is performed in a coded domain.

For example, due to said at least one extracted coded parameter, which is associated with at least one point in time, any kind of mathematical function like interpolation and/or extrapolation may be performed in the coded domain to determine said at least one time scaled coded parameter. Thus, for instance, a time scaled coded parameter in a frame may be determined by means of said time shift value and interpolation between two extracted coded parameters, or, for instance, a time scaled coded parameter in a frame may be determined by means of said time shift value and extrapolation based on at least one extracted coded parameter.

For instance, a first coded parameter of said at least two extracted coded parameters may be associated with a first frame and a second coded parameter of said at least two extracted coded parameters may be associated with a second frame, and based on this first and second coded parameters and the time shift value one of said at least one time scaled coded parameter can be calculated. This calculation may for instance be performed by means of interpolation, or by any other suited operation, e.g. by selecting one out of said at least two extracted code parameters having a small distance to the time scaled coded parameter to be determined.

For example, at least one coded parameter may be extracted from the audio/speech stream. The at least one coded parameter may then be extrapolated in the coded domain to determine at least one time scaled coded parameter.

Thus, for instance, a time scaled coded parameter in a frame may be determined by means of said time shift value and extrapolation from an extracted coded parameter.

For instance, a first coded parameter of said at least one extracted parameter may be associated with a first frame. Based on this first coded parameter and the time shift value at least one time scaled value may be calculated for a point in time which lies beyond the point in time associated with the first frame.

Further, said time scaling in the coded domain may be used with a jitter buffer, e.g. with an adaptive jitter buffer wherein the coded domain time scaling may be part of a jitter buffer management system. The coded domain time scaling may be used to extend the jitter buffer to handle late frames or late subframes. Thus, for instance, said time shift value may be controlled in dependency of the status of said jitter buffer in order to handle late frames.

It is to be understood that the term late frame in this context refers to those speech/audio encoded frames which have been delayed by network jitter. Thus, without the introduction of a jitter buffer management system, these frames may typically arrive at a point in time which is beyond the scheduled play back time.

Furthermore, the generated time scaled stream may have the same output rate even when time scaling is performed in the coded domain. Thus, a flexible coded domain parameter time scaling, e.g. based on updates in frame or subframe level basis, may be performed with constant output rate of the time scaled coded parameters. Accordingly, a receiver and/or a decoder receiving this time scaled coded parameter stream does not notice the time scaling in coded domain since the output frame rate is constant. E.g., the update of the coded parameters due to the time scaling in coded domain may be performed in regular intervals, e.g. in frame basis and/or in subframe basis.

According to an embodiment of the present invention, said at least one coded parameters represents at least one time-domain coded coefficient associated with at least one parameter type, and wherein at least one of said at least one coded parameters is associated with one single parameter type of said at least one parameter type, and wherein at least one of said at least one time scaled coded parameter associated with said one single parameter type is determined by means of at least one out of the following functions: interpolation based on at least two of said at least one coded parameters associated with said one single parameter type, and extrapolation based on at least one of said at least one coded parameters associated with said one single parameter type.

Said at least one parameter type may represent at least one parameter type of a speech/audio codec. For example, at least one of this at least one parameter type may be associated with parameters on frame level basis, and at least one of said at least one parameter type may be associated with parameters on subframe level basis.

Thus, said at least one time scaled coded parameter associated with one of said at least parameter type may be associated with the same level basis with said associated parameter type, e.g. with a frame level basis or a subframe level basis. Thus, the at least one time scaled coded parameter is updated in the same time interval as the associated extracted parameters of said parameter type.

According to an embodiment of the present invention, said at least one parameter type is at least one out of: Linear Predictive Coding (LPC) filter parameter type; pitch lag parameter type; fixed codebook gain parameter type and adaptive codebook gain parameter type.

According to an embodiment of the present invention, said at least one of said at least one coded parameter represents a group of parameters forming a parameter evolution path, wherein said coded parameters in said parameter evolution path are associated with different point in times, and wherein in said parameter evolution path at least one of said at least one coded parameter is time-shifted according to said time shift value, and wherein said at least one time scaled coded parameter associated with said parameter type is determined on the basis on the corresponding shifted parameter evolution path.

Thus, there may exist a separate parameter evolution path for each parameter type to be time scaled in the coded domain. The time scaling may be performed by inserting time intervals or removing time intervals in the corresponding parameter evolution path according to the time shift value so that respective coded parameters in said evolution path are time shifted, and by determining the at least one time scaled coded parameter associated with the corresponding parameter type based on the shifted parameter evolution path and on one of said function interpolation and extrapolation, e.g. by means of interpolation between two coded parameter of said shifted evolution path being adjacent to the time scaled coded parameter to be determined or by means of extrapolation based on at least one coded parameter of said shifted evolution path being adjacent to the time scaled coded parameter to be determined.

According to an embodiment of the present invention, time shifting said shifted parameter evolution path by a second time shift value is performed, wherein said second time shift value is determined on the basis of returning said shifted parameter evolution path to said parameter evolution path, and wherein at least one time scaled coded parameter is determined based on said parameter evolution path.

For instance, this time shifting said shifted parameter evolution path by a second time shift value represents an additional coded domain time scaling. For example, this may be performed on the coded parameter evolution line in order to re-establish frame synchronization with incoming frames.

According to an embodiment of the present invention, said time shifting is applied dependent on the result of a voiced/unvoiced speech region detector switch.

For instance, the point of re-establishment of frame synchronization may be chosen according to said result of a voiced/unvoiced speech region detector switch. E.g., this additional time scaling due to the second time shift value may be performed during regions of unvoiced speech.

According to an embodiment of the present invention, time scaling is performed at a discontinuation point, and said at least one time-shifted parameter is the at least one coded parameter having its originally associated time position after said discontinuation point, and, in case that said time shift value represents a negative value, then time-shifted parameters shifted behind the discontinuation point are cancelled from said shifted parameter evolution path.

After that time scaling has been performed at the discontinuation point, the time scaling in coded domain is performed to all received and extracted coded parameters by means of said at least one shifted parameter evolution path for each parameter type to be time scaled until a next change in time scaling with a new discontinuation point and a new time shift value is applied.

Thus, after performing the time scaling operation at a discontinuation point, the output stream is always time shifted with the same time shift value until a next change for time scaling occurs. These changes in time scale do not change the output rate of the time scaled coded parameters.

According to an embodiment of the present invention, said at least one time scaled coded parameter associated with said parameter type is associated with at least one point in time of said different points in time after the discontinuation point, and wherein each of said at least one time scaled coded parameter is determined by means of one out of the following functions: interpolation between the previous available parameter and the next available parameter of said time shifted parameter evolution path, and extrapolation based on at least one previous available parameter or on at least one next available parameter of said time shifted parameter evolution path.

Thus, said at least one time scaled coded parameter is calculated for point in time after said discontinuation point. In case no time scaling has been performed before this discontinuation point, then the respective extracted coded parameters may be outputted as zero time scaled coded parameters to the output speech/audio stream.

According to an embodiment of the present invention, said interpolation represents a linear interpolation.

According to an embodiment of the present invention, said different points in time are equally spaced and are associated with one out of a frame index associated with frames of said stream; or a subframe index associated with subframes of said stream.

According to an embodiment of the present invention, one of said at least one parameter type represents a LPC filter parameter type, and said at least one coded parameter represents at least one out of Immittance Spectral Pair (ISP) and Linear Spectrum Pair (LSP) parameters of corresponding LPC parameters.

Thus, the extracted at least two coded parameters are converted to the ISP domain, e.g. according to the AMR-WB standard, before the coded domain time-scaling is performed. According to an embodiment of the present invention, at least one of said at least one determined time scaled coded parameter is quantized before generating the time scaled encoded audio/speech stream.

Furthermore, this quantization may be performed in accordance with the respective audio/speech codec in order to fulfill the requirements of compatibility.

According to an embodiment of the present invention, a plurality of parameters of said coded parameter set represent codebook parameters associated with at least two subframes of said audio/speech stream, said codebook parameters representing coded time domain pulses, and wherein time scaling is performed at a discontinuation point, so that the coded time domain pulses after said discontinuation point are time shifted according to the time shift value, and, in case said time shift value represents a negative value, then time-shifted pulses shifted behind the discontinuation point are cancelled, and, in case said time shift value represents a positive value and thus a time interval is inserted at the discontinuation point, then this time interval is filled with a copy of preceding pulses.

Thus, e.g. a fixed codebook excitation vector of a codec, e.g. the AMR-WB codec, can be time scaled in the coded domain.

According to an embodiment of the present invention, a reindexing of said coded time domain pulses is performed after time scaling based on a codebook position rule of the speech/audio codec.

This reindexing allows to fit the time-scaled codebook to the requirements with the respective audio/speech codec.

According to an embodiment of the present invention, wherein said codebook position rule defines a codebook structure based on interleaved single-pulse permutation design, wherein positions of codebook parameters are divided into at least two tracks of predetermined interleaved positions associated with at least two subframes, and wherein said reindexing comprises: checking whether the correct number of pulses per subframe is given, and if this is not given, then checking the track containing wrong number of pulses and moving random pulses from a track containing extra pulses to the closest position on a track having too few pulses, and if said checking the correct number of pulses is successful, then checking if correct number of pulses is given on each track, and if this is not given, then moving random pulses from a track containing extra pulses to the closest position on a track having too few pulses.

According to an embodiment of the present invention, in case after said moving random pluses from track to track the re-indexed pulses still do not comply with the codebook rule, then removing extra pulses randomly or adding pulses randomly.

According to an embodiment of the present invention, said time scaling is used in a gateway in order to extend a jitter buffer.

According to an embodiment of the present invention, said speech/audio codec represents a speech codec, and the absolute value of said time shift value is a one out of a pitch cycle or a multiple of a pitch cycle.

According to an embodiment of the present invention, said speech/audio codec is a member of the Algebraic Code Excited Linear Prediction (ACELP) family of codecs.

According to an embodiment of the present invention, the time scaling in the coded domain may be performed in a media gateway configured to be used in a packet switched network, and said time scaling in the coded domain is used to extend a jitter buffer in the media gateway.

According to an embodiment of the present invention, said time scaling in the coded domain is configured to handle late frames received in jitter buffer of the media gateway.

According to an embodiment of the present invention, a time scaling control logic is configured to provide time alignment information for said time scaling in the coded domain based on the status of the jitter buffer.

According to an embodiment of the present invention, a time scaling control logic is configured to provide time alignment information for said time scaling in the coded domain based on the observed reception characteristics and jitter buffer fullness status.

These and other aspects of the invention will be apparent from and elucidated with reference to the embodiments described hereinafter.

DETAILED DESCRIPTION OF THE INVENTION

Typical speech or audio encoders, e.g. a Code Excited Linear Prediction (CELP)-based speech encoder, such as the AMR family of coders, segments a speech signal into frames, e.g. 20 msec in duration, and it may perform a further segmentation into subframes, e.g. twice or four time within a frame. Then a set of coded domain parameters may be computed, quantized, and transmitted to a receiver. This set of parameters may comprise a plurality of parameter types, e.g. a set of schematic Linear Predictive Coding (LPC) coefficients for a frame or subframe, a pitch value for a frame or subframe, a fixed codebook gain for a frame or subframe, an adaptive codebook gain for a frame or subframe, and/or a fixed codebook for a frame or subframe.

Thus, in current speech and audio codecs, the parametric model and coded time domain coefficients are updated on regular interval basis, e.g. on frame basis or on subframe basis.

According to the present invention a parameter level coded domain time scaling is performed directly on the coded domain parameters.

In one embodiment the presented approach can be used for time scaling of the audio signal as part of a jitter buffer management system in the scope of packet based speech communication. By adopting such an approach negates the need for an audio/speech decoding stage and apparatus to be present as part of a jitter buffer management system. Instead, the time scaling, which is an integral part of most jitter buffer management systems, takes place in the coded parameter domain.

By using such an approach it may be possible to effectuate time scaling in the coded domain such that it may have an equivalent outcome to that which is achieved when the scaling is performed on a sample by sample basis over a discrete time domain signal.

Figure 1A:
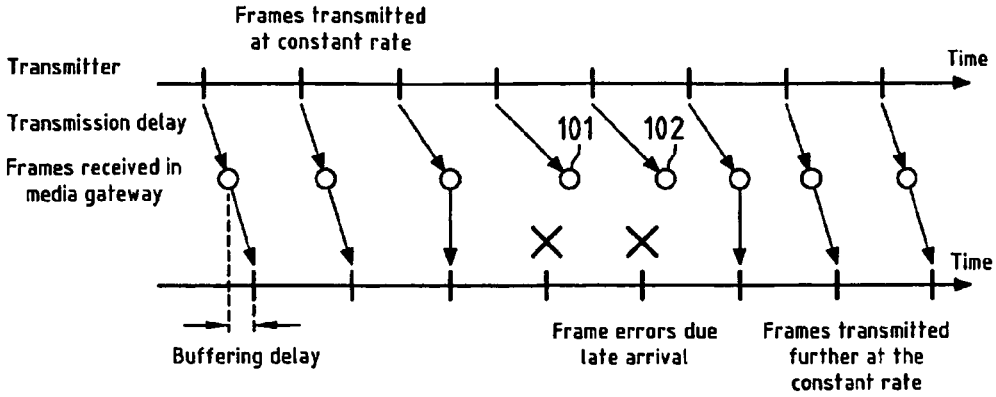
FIG. 1*a*: a prior art method of fixed buffering of incoming frames in a media gateway.
Figure 1B:
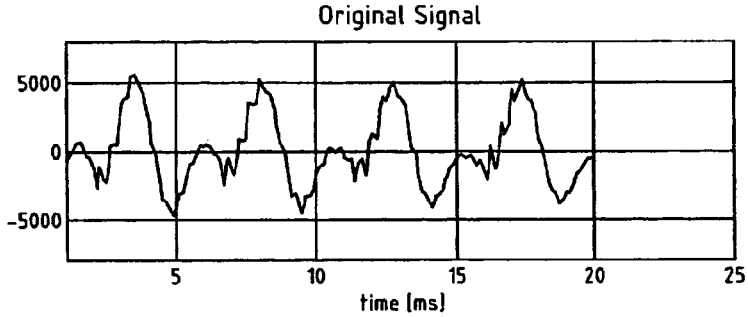
FIGS. 1*b*-1*d*: an example of pitch synchronous time domain time scaling.
Figure 1C:
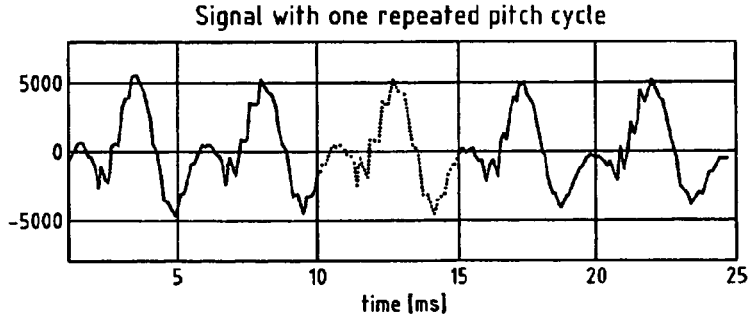
Figure 1D:
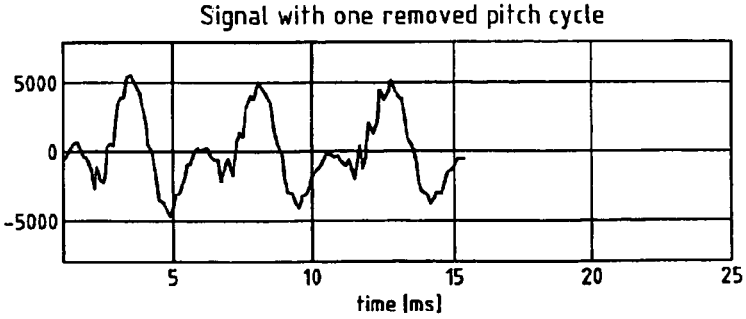
Figure 1E:
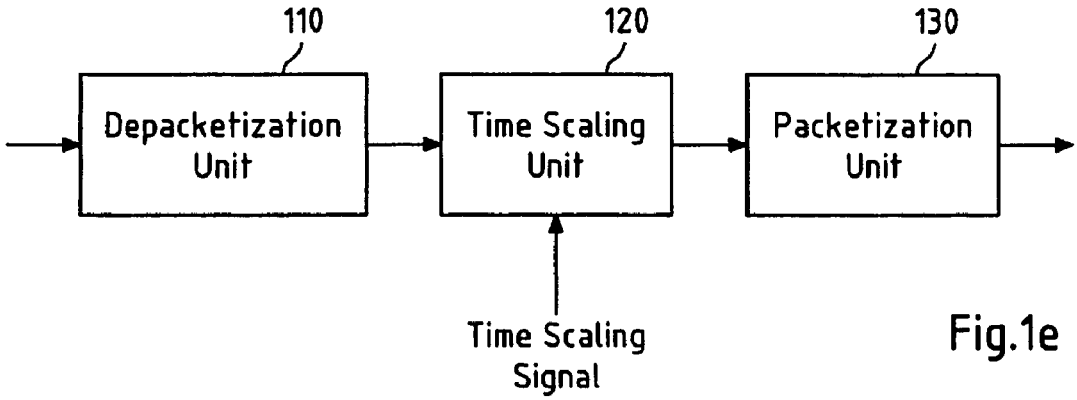
FIG. 1*e*: a schematic block diagram of a first exemplary embodiment of the present invention.

FIG. 1*e* depicts a schematic block diagram of a first exemplary embodiment of the present invention.

A depacketization unit 110 may receive packets from an audio or speech stream, e.g. Real-Time-Transport (RTP) packets, from a network and extracts the coded domain parameters, e.g. at least two coded domain parameters. These at least two coded domain parameters are fed to a time scaling unit 120. The time scaling unit 120 may further receive a time scaling signal, wherein this time scaling signal may represent a time shift value to be applied to the audio or speech stream. This time scaling signal may be generated by a time scaling control logic (not depicted in FIG. 1*e*) that calculates time alignment commands to the time scaling unit based on the status of a receive buffer (not depicted in FIG. 1*e*) located before depacketization unit 110 and from a network analyzer (not depicted in FIG. 1*e*) that may compute a set of parameters describing the current reception characteristics based on received frames.

This receive buffer may be used to store the received audio/speech frames waiting for further processing. The buffer is assumed to have the capability to arrange the received frames into correct chronological order and to provide the next frame in sequence (or the information about the missing frame) upon request. This receive buffer may also be placed in the depacketization unit 110.

Figure 1F:
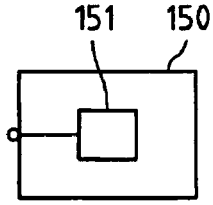
FIG. 1*f*: a schematic block diagram of a second exemplary embodiment of the present invention.
Figure 1G:
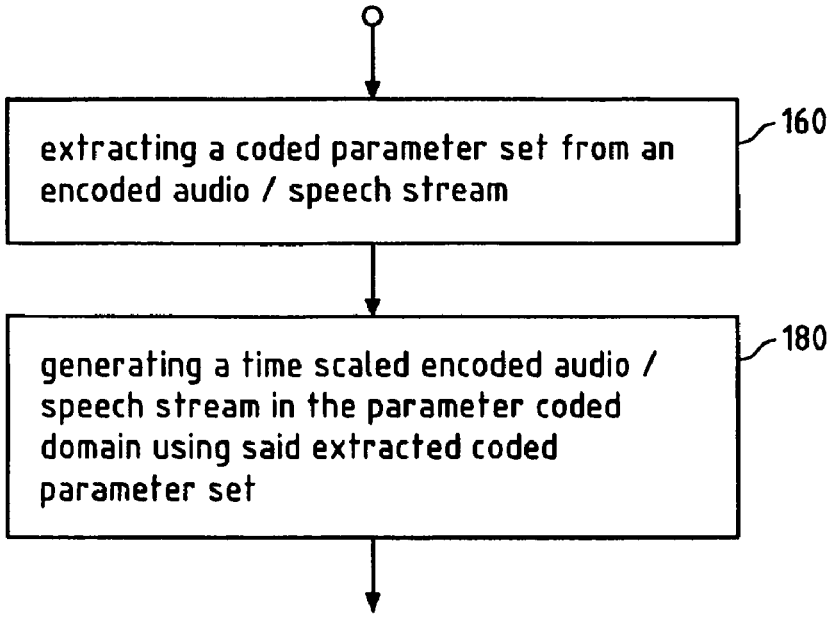
FIG. 1*g*: a schematic flowchart of a first exemplary embodiment of a method according to the present invention.

The time-scaling unit 120 receives said at least two coded domain parameters from said encoded audio/speech stream, and it extracts a coded parameter set from an encoded audio/speech stream, as depicted in step 160 in the schematic flowchart of FIG. 1*g*. Then, the time-scaling unit 120 generates a time scaled encoded audio/speech stream in the parameter coded domain using said extracted coded parameter set (step 180 in FIG. 1*g*).

Figure 1H:
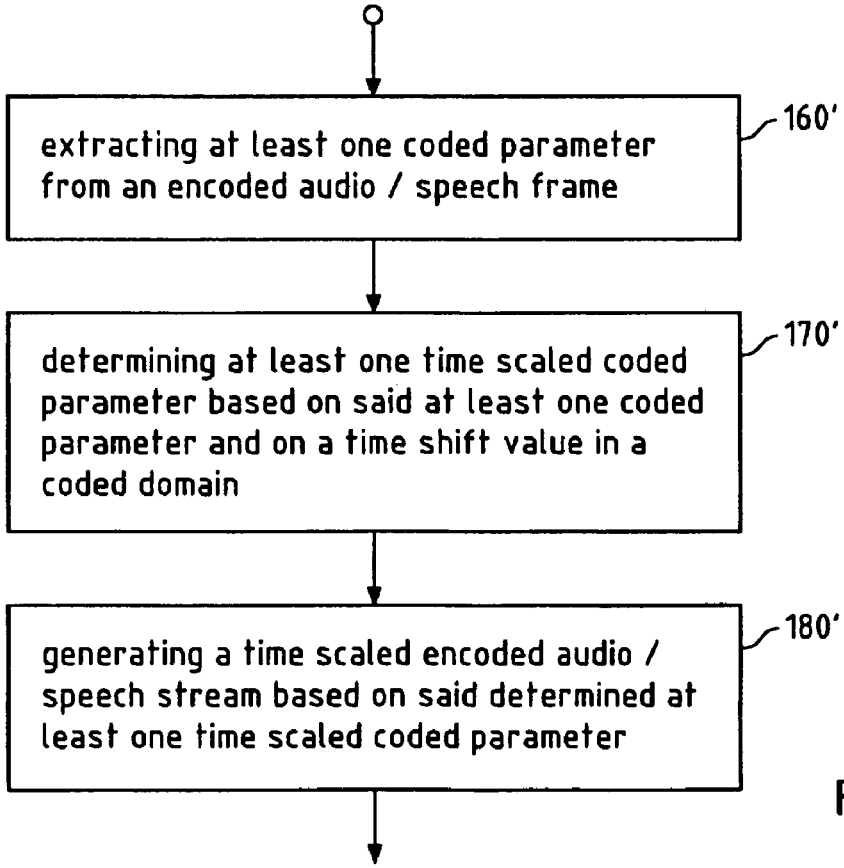
FIG. 1*h*: a schematic flowchart of a second exemplary embodiment of a method according to the present invention.

For instance, as exemplarily depicted the flowchart in FIG. 1*h*, the time-scaling unit 120 may extract at least two coded domain parameters from said parameter set (step 160'), and the time-scaling unit 120 may determine at least one time scaled coded parameter based on said at least two coded parameters and on a time shift value, wherein this determining is performed in a coded domain (step 170' in FIG. 1*h*). After performing this time scaling in the coded domain the packetisation unit 130 may generate a time scaled encoded audio/speech stream based on said determined at least one time scaled coded parameter, as exemplarily depicted in step 180 in FIG. 1*h*.

For instance, said coded domain time scaling may be used to enable an adaptive jitter buffer management, e.g. based on sample based accuracy. For example, said coded domain time scaling may be performed without changing the input stream rate and the output stream rate, and the decoded time domain output may simply be time scaled on sample basis compared to the input stream.

Thus, for instance, this first exemplary embodiment of the present invention depicted in FIG. 1*e* and any of the exemplary methods depicted in FIGS. 1*g* and 1*h* may be used in a gateway in order to enable time scaling on sample based accuracy during active speech without the need of transcoder, since decoding of the speech signal is not necessary to perform sample based time scaling due to performing time scaling in the coded domain according to the present invention.

Furthermore, as depicted as second exemplary embodiment of the present invention in FIG. 1*f*, an apparatus 150 of the present invention, e.g. the apparatus depicted in FIG. 1*e*, may comprise a processor 150 configured to extract at least one coded parameter from an encoded audio/speech stream, said audio/speech stream being distributed to a sequence of packets, wherein said at least one coded parameters are associated with at least one point in time; and configured to determine at least one time scaled coded parameter based on said at least one coded parameter and on a time shift value, wherein this determining is performed in a coded domain; and configured to generate a time scaled encoded audio/speech stream based on said determined at least one time scaled coded parameter.

For instance, said at least one extracted coded parameter represents at least two extracted coded parameters, which are associated with at least two different point in times, so that any kind of interpolation may be performed in the coded domain to determine said at least one time scaled coded parameter. Thus, for instance, a time scaled coded parameter in a frame may be determined by means of said time shift value and interpolation between two extracted coded parameters.

Furthermore, for example, at least one coded parameter may be extracted from the audio/speech stream. The at least one coded parameter may then be extrapolated in the coded domain to determine at least one time scaled coded parameter. Thus, for instance, a time scaled coded parameter in a frame may be determined by means of said time shift value and extrapolation from an extracted coded parameter.

For instance, said receive buffer may represent an adaptive jitter buffer, and this adaptive jitter buffer and the coded domain time scaling are part of a jitter buffer management system. The coded domain time scaling may be used to extend the jitter buffer to handle late frames or late subframes. Thus, for instance, said time shift value may be controlled in dependency of the status of said jitter buffer in order to handle late frames.

Figure 7:
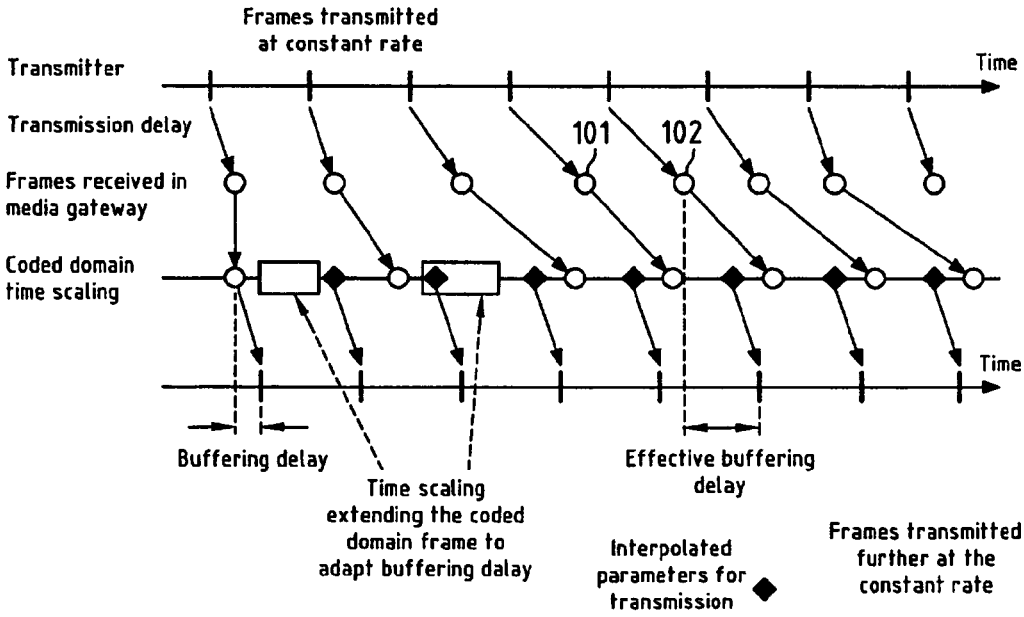
FIG. 7: a schematic diagram illustrating an exemplary use of the present invention in a gateway for performing time scaling.

This is exemplarily depicted in FIG. 7 which depicts a schematic diagram illustrating an exemplary use of the present invention in a gateway for performing time scaling. In this example, two time scaling operations in the coded domain according to the present invention are performed to introduce a further time delay to the buffered audio/speech stream. The time scaled coded parameters, denoted as interpolated parameters for transmission in FIG. 7, may be transmitted further to another network or may be forwarded to playback device in a terminal. Due to the time scaling in coded domain, even the late received frames 101 and 102 can be handled and the time scaled coded parameters can be outputted in a regular interval, as depicted in FIG. 7.

A further aspect to the invention is as a consequence of time scaling the audio signal within the coded domain. As depicted in FIG. 7 frame synchronization may be lost between the received frames from the network and output frames from the jitter buffer management system once coded domain time scaling has been first applied. This out of synchronization state may remain until the end of the speech burst. This would mean that the coded domain parameter evolution path would have to be maintained for the duration of afore mentioned speech burst. Synchronisation then may only be re-established when the jitter buffer is re-initialised at the start of the next active speech burst.

Figure 8:
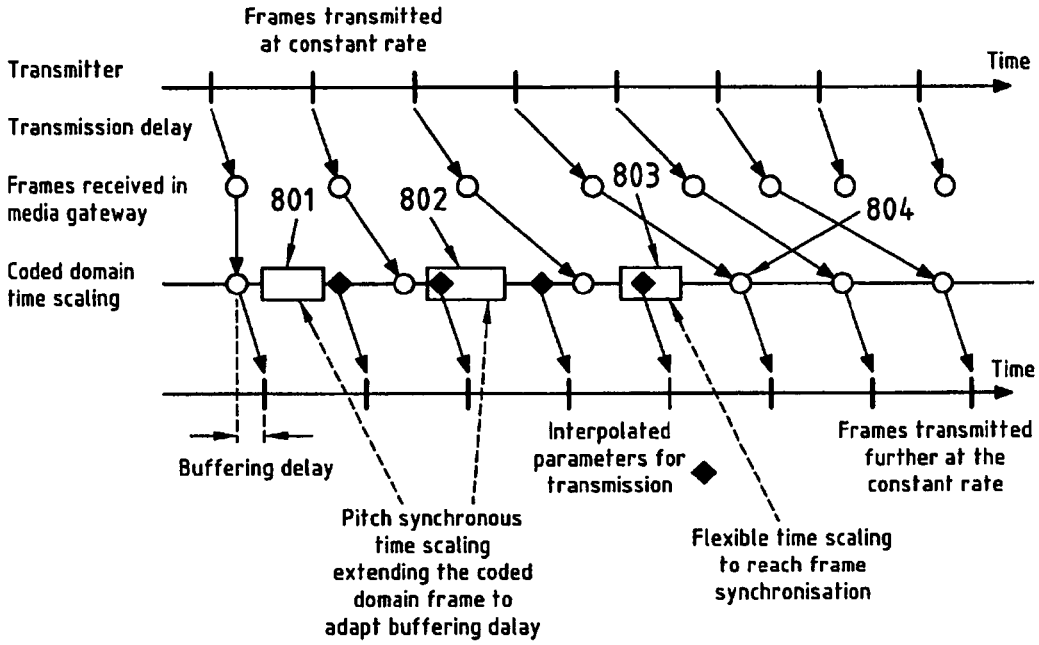
FIG. 8: a schematic diagram illustrating an exemplary of use of a second aspect of the present invention in a gateway for performing time scaling.

In some embodiments of the present invention it may be possible to overcome this effect by introducing an extra time scaling step. This extra step may be introduced such that the parameter evolution path may be extended or reduced until a state of frame synchronization re-established during an active speech burst. From this point the received un-interpolated coded parameters may be used to produce the output speech/audio. This is exemplary depicted in FIG. 8 which depicts a schematic diagram illustrating an exemplary use of the present invention in a gateway performing time scaling. In this example, two initial time scaling operations, 801 and 802, are performed in the coded domain according to the present invention to extend the coded parameter evolution line. Further an additional coded domain time scaling step, 803, is performed on the coded parameter evolution line in order to re-establish frame synchronisation with the incoming frames received by the media gateway. The point of re-establishment of frame synchronisation is depicted as 804, in FIG. 8. Further, in some exemplary embodiments of the present invention this extra step of time scaling may take place during regions of unvoiced speech. Thus the decision to apply the additional time scaling step would be driven by voice/unvoiced speech detector switch.

Now, by re-establishing frame synchronization with the received coded parameter stream may introduce some distortions. This may be evident in any predictive quantization tool that utilize past stored values in order to predict a current value. Thus at the point of re-establishment of synchronization there may be a discrepancy between the predictive quantization tool memory at the decoder and the memory used to predict the same value at the encoder. This discrepancy may be compensated by either substituting predictor memories with the received frame's quantized parameters, or by simply using the parameter values present in the quantizer tool.

In the sequel the present invention will be exemplarily described with respect to the AMR-WB codec, but it is to be understood that the present invention and the exemplary method of time scaling can also be applied to any other suited speech or audio codec like other Code Excited Linear Prediction (CELP) codecs or other frame based codecs.

Figure 2A:
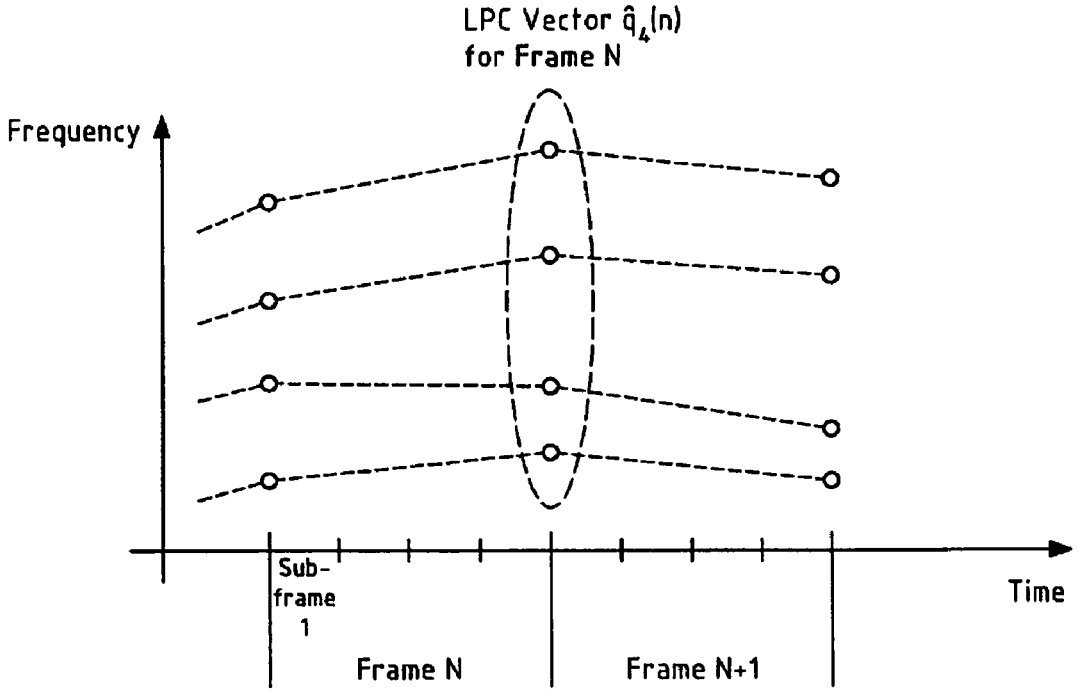
FIG. 2*a*: a schematic LPC parameter evolution path from frame to frame in ISP domain.

FIG. 2*a* depicts a schematic Linear Predictive Coding (LPC) parameter evolution path from frame to frame in Immittance Spectral Pair (ISP) domain extracted from an AMR-WB encoded audio/speech stream.

AMR-WB LPC parameters are quantized in ISP representation in the frequency domain. The LPC analysis is performed once per speech frame. As depicted in FIG. 2*a*, the ISP parameters are updated with the same interval.

Since the LPC parameter interpolation within the speech frame is done in ISP, in this exemplary embodiment the LPC parameter time scaling is performed in the same domain. Due to this time scaling in the coded domain according to the present invention, there is no need to convert the parameters to LPC domain since no LPC analysis or synthesis filtering is needed. This enables a decreased complexity of the time scaling algorithm.

For instance, the ISP domain representation of the LPC coefficients depicted in FIG. 2*a* is in the frequency range of 0 to 6400 Hz when the sampling frequency is 12800 Hz. FIG. 2*a* presents as an example only the subset of four ISP coefficients, but the number of ISP coefficients may vary from this value in dependency on the applied standard.

The AMR-WB applies the actual quantized LP only in the fourth subframe, while the first, second and third subframe parameters are interpolated between the current frame N and previous frame N−1. For example, let $\hat{q}_4^{(n)}$ be the ISP vector at the 4th subframe of the frame N, as depicted in FIG. 2*a*, and $\hat{q}_4^{(n-1)}$ the ISP vector at the 4th subframe of the past frame N−1. The interpolated ISP vectors at the 1st, 2nd, and 3rd subframes are given by $$\hat{q}_1^{(n)}=0.55\hat{q}_4^{(n-1)}+0.45\hat{q}_4^{(n)},$$

$$\hat{q}_2^{(n)}=0.2\hat{q}_4^{(n-1)}+0.8\hat{q}_4^{(n)},$$

$$\hat{q}_3^{(n)}=0.04\hat{q}_4^{(n-1)}+0.96\hat{q}_4^{(n)},$$

These different interpolated ISP vectors are used in a decoder to compute a different LP filter at each subframe.

Time scaling of coded domain parameters according to the exemplary method of the present invention depicted in FIGS. 2*a*-2*e* is performed either by removing or inserting a predetermined length from the parameter evolution part according to a desired time-shift value.

Figure 2B:
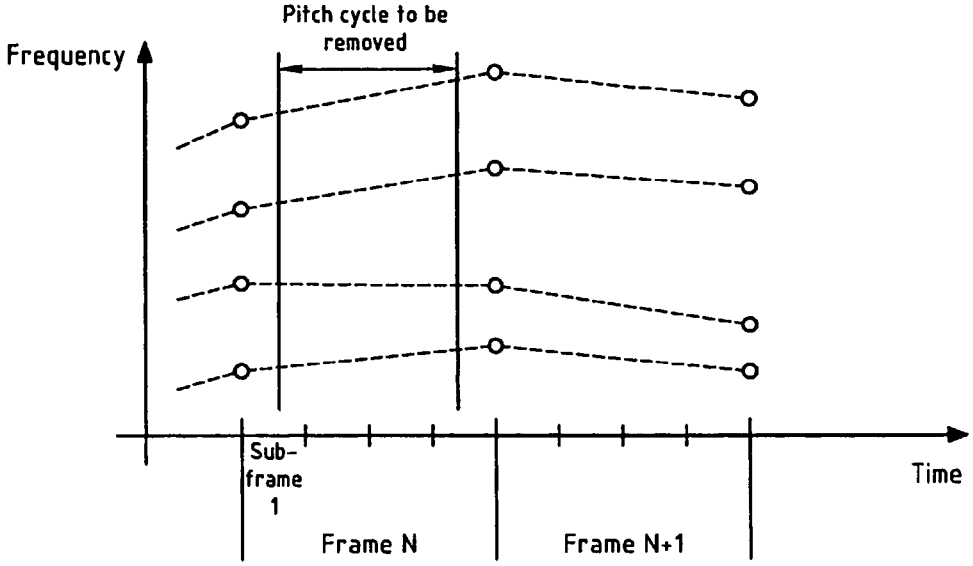
FIG. 2*b*: a schematic pitch cycle to be removed from the LPC parameter evolution path.

FIG. 2*b* exemplarily illustrates a case when a negative time shift value for time scaling is applied during frame N, and thus an interval according to this time shift value is removed as predetermined length from the evolution path. In FIG. 2*b*, this time shift value to be removed represents a pitch cycle, but any other time shift value may be applied for time scaling.

Figure 2C:
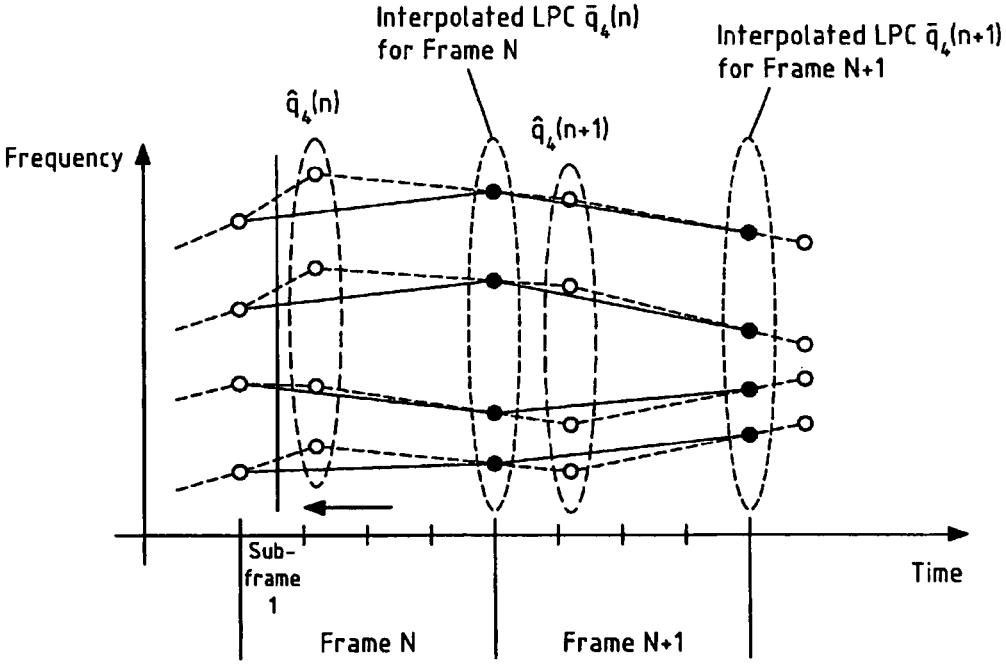
FIG. 2*c*: a schematic interpolated LPC parameter evolution path according to an exemplary time scaling of the present invention in which a pitch cycle has been removed.

As a result, the ISP vectors of frame N and of the at least one next frame N+1 ($\hat{q}_4^{(n)}$, $\hat{q}_4^{(n+1)}$) are time shifted in negative direction, as depicted in FIG. 2*c*. In case any ISP vectors are within the time interval to be removed (not depicted in FIG. 2*c*), then these ISP vectors are removed from the time shifted evolution path.

Now, the desired time scaled coded domain ISP vector $\bar{q}_4^{(n)}$ is determined by interpolating between the previous and next available parameter vector in the time shifted evolution path, i.e. out of the non time shifted coded domain vectors associated with frame N−1 and less and out of the time shifted coded domain vectors associated with original frame N and higher. In the same way subsequent desired time scaled coded domain ISP vectors $\bar{q}_4^{(n+1)}$, $\bar{q}_4^{(n+2)}$ . . . may be determined.

For instance, as exemplarily depicted in FIG. 2*c*, a linear interpolation between the previous available parameter vector $\hat{q}_4^{(n)}$ and the next available parameter vector $\hat{q}_4^{(n+1)}$ may be applied to determine the time scaled coded domain vector $\bar{q}_4^{(n)}$, but there are many other possible methods for the interpolation of coded domain parameters.

E.g., with, respect to the ISP vector time scaling, the interpolation may also be performed on subframe accuracy. In this case, in FIG. 2*c*, the ISP update $\bar{q}_4^{(n)}$ for frame N would be selected from the fourth subframe N+1.

A similar operation may be performed when said time shift value for time scaling represents a positive value, i.e. a signal extension is conducted.

Figure 2D:
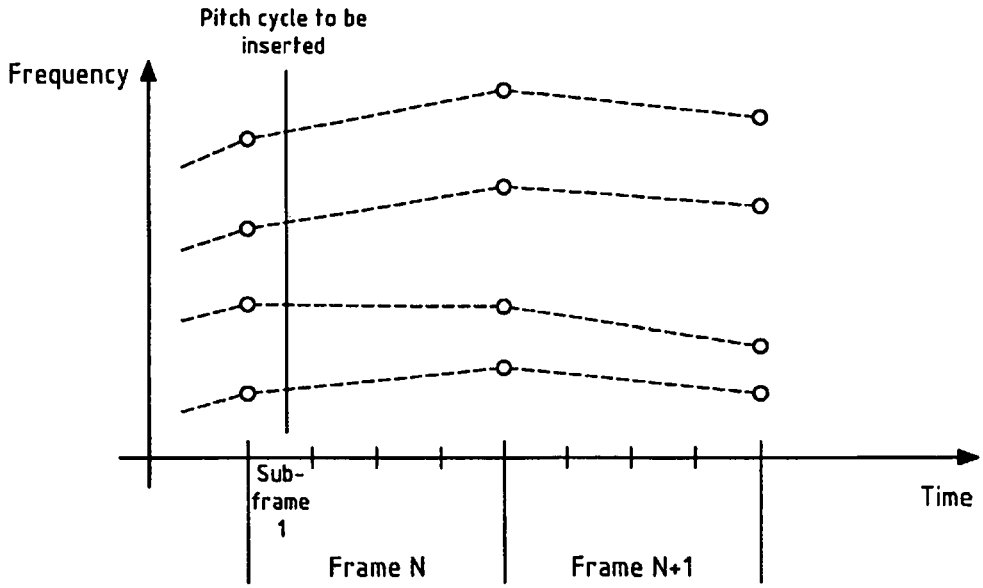
FIG. 2*d*: a schematic pitch cycle to be added to the LPC parameter evolution path depicted in FIG. 2*a;*

FIG. 2*d* exemplarily illustrates a case when such a positive time shift value for time scaling is applied during frame N, and thus an interval according to this time shift value is inserted as predetermined length from the evolution path. In FIG. 2*d*, this time shift value to be inserted represents a pitch cycle, but any other time shift value may be applied for time scaling.

Figure 2E:
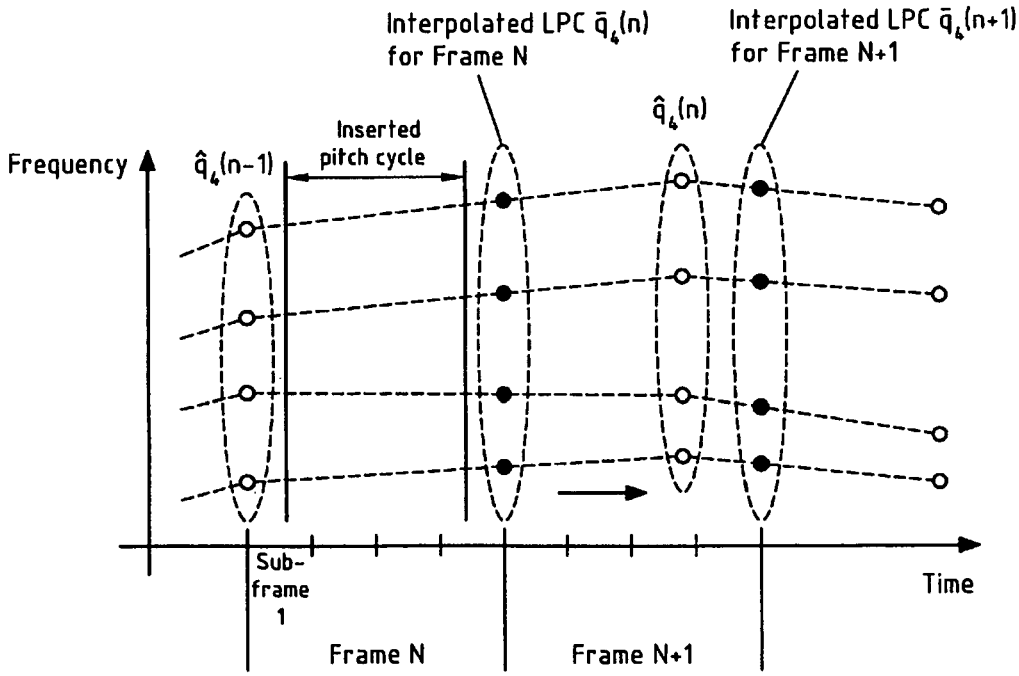
FIG. 2*e* a schematic interpolated LPC parameter evolution path according to an exemplary time scaling of the present invention in which a pitch cycle has been added.

As a result, the ISP vectors of frame N and of the at least one next frame N+1 ($\hat{q}_4^{(n)}$, $\hat{q}_4^{(n+1)}$) are time shifted in positive direction, as depicted in FIG. 2*e*.

Now, the desired time scaled coded domain ISP vector $\bar{q}_4^{(n)}$ is determined by interpolating between the previous and next available parameter vector in the time shifted evolution path, i.e. out of the non time shifted coded domain vectors associated with frame N−1 and less and out of the time shifted coded domain vectors associated with frame N and higher.

For instance, as exemplarily depicted in FIG. 2*e*, a linear interpolation between the previous available parameter vector $\hat{q}_4^{(n-1)}$ and the next available parameter vector $\hat{q}_4^{(n)}$ may be applied to determine the time scaled coded domain vector $\bar{q}_4^{(n)}$, but there are many other possible methods for the interpolation of coded domain parameters.

E.g., as mentioned above, with respect to the ISP vector time scaling, the interpolation may also be performed on subframe accuracy.

Furthermore, the new interpolated time-scaled coded domain ISP vectors may be quantized according to the respective audio/speech codec in order to fulfill the requirements of compatibility. Thus, in the present example the new interpolated LPC coefficients in ISP domain at the frame border need to be quantized according to the AMR-WB predictive multi slot quantization tool with moving-average (MA) prediction.

For instance, a prediction and quantization may be performed as follows. Let z(n) denote the mean-removed ISP vector at frame N. Then, the prediction residual vector r(n) may be given by $$r(n)=z(n)-p(n),$$

where p(n) is the predicted line spectrum frequency (LSF) vector at frame N. First order MA prediction is used where:

$$p(n)=\frac{1}{3}\hat{r}(n-1),$$

where $\hat{r}(n-1)$ is the quantized residual vector at the past frame N−1.

The interpolated ISP parameter may be given by $$z_\alpha(n)=\alpha z(n)+(1-\alpha)z(n-1)$$

where the interpolation parameter $\alpha$ depends on the time of the extraction between the boundaries of frame N and N−1. The prediction residual vector of the time scaled parameter $r_\alpha(n)$ is given by:

$$r_\alpha(n)=z_\alpha(n)-br_\alpha(n-1).$$

Further when decoding the quantised ISP parameter vector $\hat{z}_\alpha(n)$, the quantised residual vectors are utilised as follows:

$$\hat{z}_\alpha(n)=\hat{r}_{60}(n)+b\hat{r}_\alpha(n-1),$$

where $\hat{r}_\alpha(n)$ is the quantized residual vector in frame N.

Now, according to the example embodiment of the present invention frame synchronization may be lost once the time shift value has been applied to the Immittance Spectral Pair parameters. Thus, in the present example the interpolation of the new LPC coefficients in the ISP domain may need to be maintained for subsequent frames, until as such a state of synchronization is re-established. Typically this may take place when the jitter buffer is re-initialized after a speech burst. In some embodiments of the present invention this may be achieved by applying an extra time shift step to the ISP parameters evolution path.

According to the present example, re-establishing frame synchronization in frame N+2, say, may result in a decoded ISP vector of $$\hat{z}(n+2)=\hat{r}(n+2)+b\hat{r}_\alpha(n+1)$$

where the residual vector $\hat{r}(n+2)$ is time aligned to the received encoded frame, and the residual vector $\hat{r}_\alpha(n+1)$ is time aligned on the interpolated parameter evolution path. For instance the prediction without coded domain time scaling at frame N+2 would be $$\hat{z}(n+2)=\hat{r}(n+2)+b\hat{r}(n+1)$$

Further, as $\hat{r}_\alpha(n+1)$ and $\hat{r}(n+1)$ may have different values, the value of $\hat{z}(n+2)$ at the decoder may be different to the equivalent value which would have been processed at the encoder. This discrepancy may be handled in one of two ways. Firstly, the quantised residual extracted from the interpolated evolution path may be modified by substituting the value of $\hat{r}_\alpha(n+1)$ with that received by the decoder $\hat{r}(n+1)$. Secondly the value of $\hat{r}_\alpha(n+1)$ may remain unchanged.

Figure 3A:
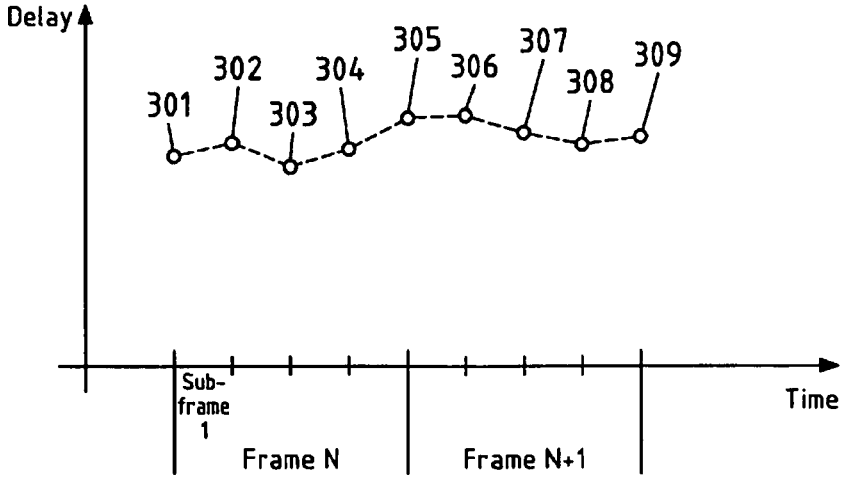
FIG. 3*a*: a schematic pitch lag parameter evolution path from subframe to subframe.

FIG. 3*a* depicts a schematic pitch lag parameter evolution path from subframe to subframe extracted from an AMR-WB encoded audio/speech stream.

The time scaling of the pitch lag parameters according to the exemplary method of the present invention depicted in FIGS. 3*a*-3*e* may be performed in a similar way as the LPC parameter processing described above, thus it is performed either by removing or inserting a predetermined length from the parameter evolution part according to a desired time shift value.

Figure 3B:
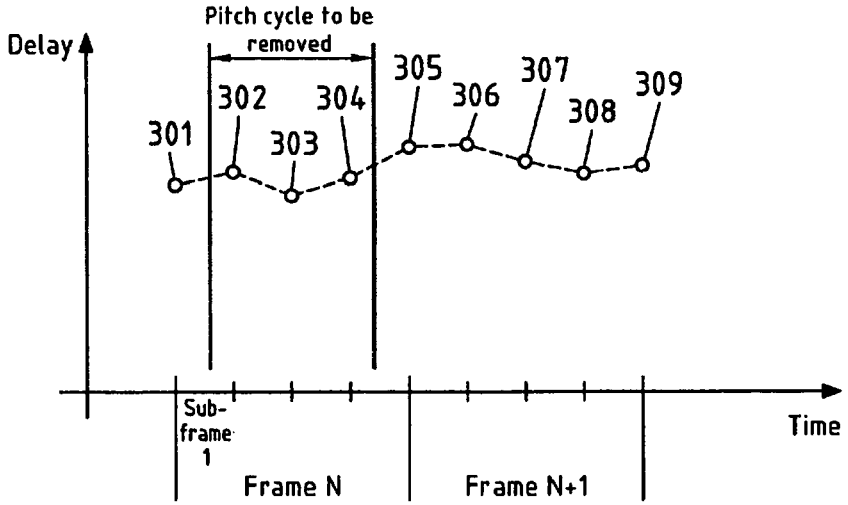
FIG. 3*b*: a schematic pitch cycle to be removed from the pitch lag parameter evolution path.

FIG. 3*b* exemplarily illustrates a case when a negative time shift value for time scaling is applied during frame N, and thus an interval according to this time shift value is removed as predetermined length from the parameter evolution path. In FIG. 3*b*, this time shift value to be removed represents a pitch cycle, but any other time shift value may be applied for time scaling.

Figure 3C:
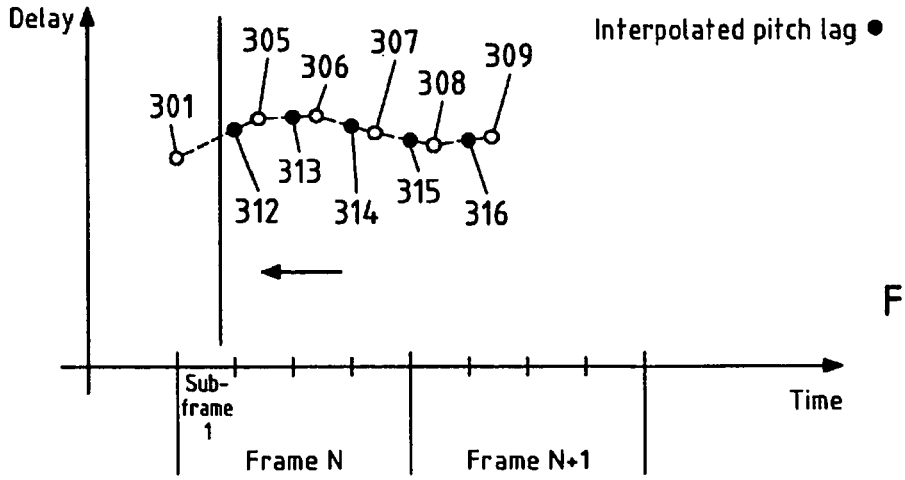
FIG. 3*c*: a schematic interpolated pitch lag parameter evolution path according to an exemplary time scaling of the present invention in which a pitch cycle has been removed.

As a result, the pitch lag parameters 302,303,304 associated with subframes 1-3 of frame N fall within the time interval to be removed, and thus these lag parameters 302, 303,304 are removed in the time-shifted parameter evolution path, and the subsequent subframes 305,306,307,308,309 are time-shifted in negative direction in accordance with the length of the removed pitch cycle, as depicted in FIGS. 3*b* and 3*c*.

Now, the desired time scaled coded domain pitch lag parameters 312,313,314,315,316 can be determined by interpolating between the previous and next available pitch lag parameter in the time shifted evolution path, i.e. out of the non time shifted pitch lag parameter 301 associated with frame N−1 and out of the time shifted pitch lag parameters 305,306, 307,308,309 associated with original frame N and higher. In the same way subsequent desired time scaled coded domain pitch lag parameters may be determined.

For instance, as exemplarily depicted in FIG. 3*c* and aforementioned with respect to LPC time scaling, a linear interpolation between the previous available parameter and the next available pitch lag parameter may be applied to determine the time scaled coded domain pitch lag parameters 312,313,314, 315,316, but there are many other possible methods for the interpolation of coded domain parameters.

Figure 3D:
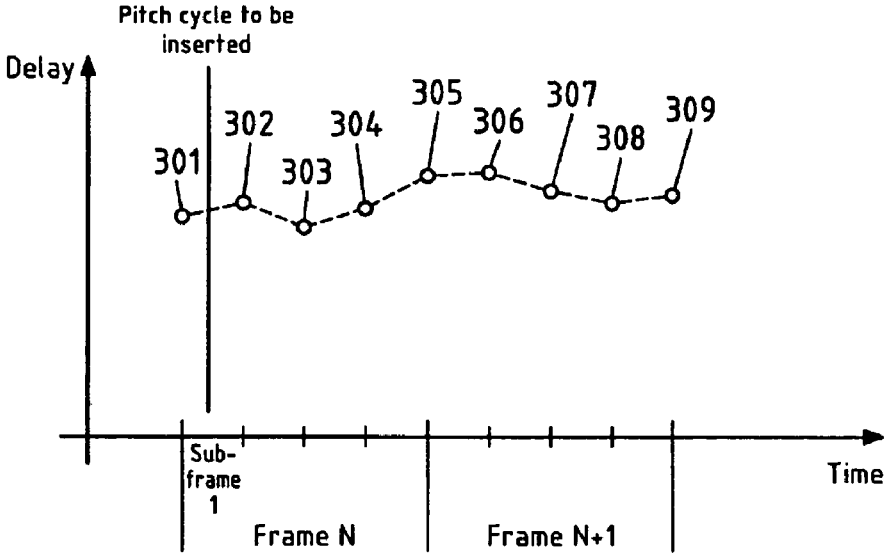
FIG. 3*d*: a schematic pitch cycle to be added to the pitch lag parameter evolution path depicted in FIG. 3*a;*

FIG. 3*d* exemplarily illustrates a case when a positive time shift value for time scaling is applied during frame N, and thus an interval according to this time shift value is inserted as predetermined length from the evolution path. In FIG. 3*d*, this time shift value to be inserted represents a pitch cycle, but any other time shift value may be applied for time scaling.

Figure 3E:
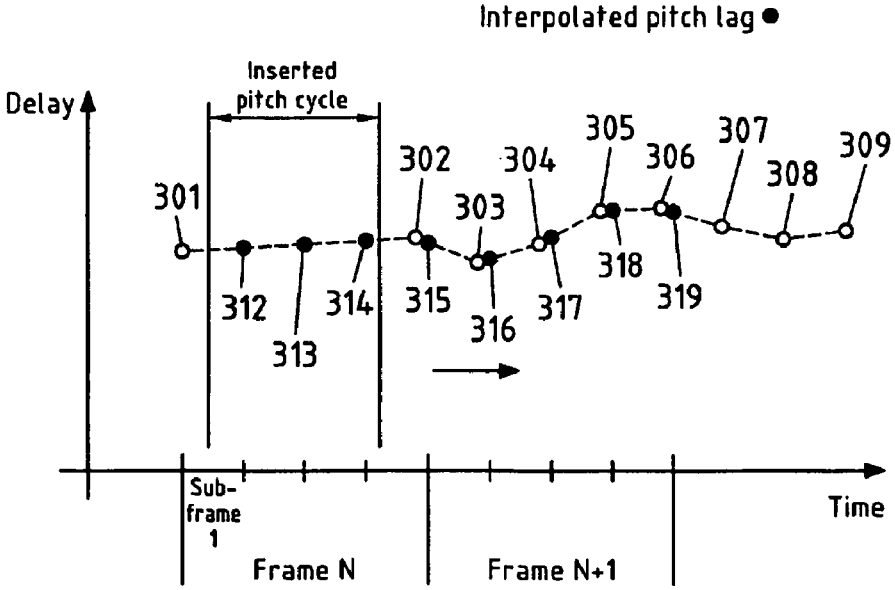
FIG. 3*e*: a schematic interpolated pitch lag parameter evolution path according to an exemplary time scaling of the present invention in which a pitch cycle has been added.

As a result, the pitch lag parameters 302,303,304,305, 306,307,308,309 are time-shifted in positive direction, as depicted in FIG. 3*e*.

Now, with respect to depicted frames N and N+1, due to this time-shift time scaled coded domain pitch lag parameters 312,313,314, 315,316,317,318,319 has to be determined for subframes 1-4 of both frames N and N+1, respectively. These desired time scaled coded domain pitch lag parameters 312, 313,314, 315,316,317,318,319 are determined by interpolating between the previous and next available parameter vector in the time shifted evolution path, i.e. out of the non time shifted coded pitch lag parameter 301 and out of the time shifted pitch lag parameters 302,303,304,305, 306,307.

For instance, as exemplarily depicted in FIG. 3*e* and aforementioned with respect to LPC time scaling, a linear interpolation between the previous available parameter and the next available pitch lag parameter may be applied to determine the time scaled coded domain pitch lag parameters 312,313,314, 315,316,317,318,319, but there are many other possible methods for the interpolation of coded domain parameters.

Furthermore, the determined time scaled coded domain pitch lag parameters may be quantized according to the respective audio/speech codec in order to fulfill the requirements of compatibility.

AMR-WB encoder conducts open-loop pitch lag estimation once a frame to guide the more accurate closed-loop estimation in every subframe. The subframe level pitch lag is further scalar quantized using either absolute or differential quantization. The lowest AMR-WB encoding mode employs absolute quantization of pitch lag for the first subframe after which the three remaining subframes are quantized differentially to the previous subframe. The higher AMR-WB encoding modes employ absolute value quantization for the first and third and differential for second and fourth subframe. Thus, the determined time scaled coded domain pitch lag parameters may be quantized according the AMR-WB standard in order to be compatible.

The interpolation between subframes may lead into a situation where the differential quantization of pitch lag parameter may not suffice. That is, the new interpolated value may be outside the differential codebook. In that case all interpolated pitch lag values within the frame could for example be smoothed with different interpolation scheme to accommodate the differential quantization, or, as another alternative, the closed possible quantized pitch lag value may be applied.

Furthermore, the above described time scaling of pitch lag parameters and/or LPC parameters may be performed in a similar manner to other coded domain parameters, e.g. to adaptive and fixed codebook gain parameters of an AMR-WB.

For instance, said adaptive and fixed codebook gain parameters may be time scaled by inserting or removing a time interval according to a desired time shift value in the parameter evolution path and by determining time scaled parameters by means of interpolation for each subframe, as described above with respect the pitch lag parameters.

Similar to LPC and pitch lag time scaling, the time scaled interpolated gain parameters may be quantized according to the speech/audio codec.

In AMR-WB, adaptive codebook gain is quantized as such, but the fixed codebook gain quantisation utilises MA prediction. The fixed codebook gain quantization is performed using MA prediction with fixed coefficients [3GPP TS 26.190, AMR-WB transcoding functions]. The 4th order MA prediction is performed on the innovation energy as follows. Let E(n) be the mean-removed innovation energy (in dB) at subframe n, and given by $$E(n) = 10\log\left(\frac{1}{N}g_c^2\sum_{i=0}^{N-1}c^2(i)\right) - \overline{E}$$

where N=64 is the subframe size, c(i) is the fixed codebook excitation, and $\overline{E}$=30 dB is the mean of the innovation energy. The predicted energy is given by $$\tilde{E}(n) = \sum_{i=1}^{4} b_i \hat{R}(n-i)$$

where $[b_1\ b_2\ b_3\ b_4]$=[0.5, 0.4, 0.3, 0.2] are the MA prediction coefficients, and $\hat{R}(k)$ is the quantized energy prediction error at subframe k. The predicted energy is used to compute a predicted fixed-codebook gain $g'_c$ by substituting E(n) by $\tilde{E}(n)$ and $g_c$ by $g'_c$. This is done as follows. First, the mean innovation energy is found by $$E_i = 10\log\left(\frac{1}{N}\sum_{i=0}^{N-1}c^2(i)\right)$$

and then the predicted gain $g'_c$ is found by $$g'_c = 10^{0.05(\tilde{E}(n)+\overline{E}-E_i)}.$$

A correction factor between the gain $g_c$ and the estimated one $g'_c$ is given by $$\gamma = g_c/g'_c.$$

Note that the prediction error is given by $$R(n) = E(n) - \tilde{E}(n) = 20\log(\gamma).$$

The pitch gain, $g_p$, and correction factor γ are jointly vector quantized using a 6-bit codebook for modes 8.85 and 6.60 kbit/s, and 7-bit codebook for other modes.

In the decoder, the quantised fixed codebook gain is determined using the predicted gain and correction factor from the codebook by $$\hat{g}_c = \hat{\gamma} g'_c.$$

Therefore, it is feasible to conduct the fixed codebook gain processing in correction factor level. Interpolation of the fixed codebook gain is done in similar manner to pitch lag parameter as depicted in FIGS. 3*a*-3*e* and described above.

Furthermore, for instance, in AMR-WB the fixed codebook is transmitted in form a codevector in each subframe. According to an exemplary method of the present invention, a time scaling may also be applied to these transmitted codebook parameters. The proposed method may also be applied for time scaling of other codebooks.

The AMR-WB coded utilises an adaptive codebook and a fixed codebook. Since the adaptive codebook is created in the decoder using the pitch lag, gain parameters and past excitation, there is no specific time scaling operation needed for it. Thus, according to the present invention the adaptive codebook has not to be considered when performing time scaling leading to significant saving in the computational load compared to time scaling performed in a transcoder.

The AMR-WB fixed codebook structure is based on interleaved single-pulse permutation design. The 64 positions in the codebook codevector are divided into 4 tracks of interleaved positions, with 16 positions in each track. The different codebooks at the different rates are constructed by placing a certain number of signed non-zero pulses in the tracks (from 1 to 6 pulses per track, depending on the used AMR-WB mode). The codebook index, or codeword, represent the pulse positions and sign in each track. Thus, no codebook storage is needed, since the excitation vector at the decoder can be constructed through the information contained in the index itself and no lookup tables are needed.

An exemplary method for performing time scaling of a fixed codebook, i.e. time scaling of time domain coded residual signal, will be presented with respect to FIGS. 4*a*-4*e* and FIG. 5.

Figure 4A:
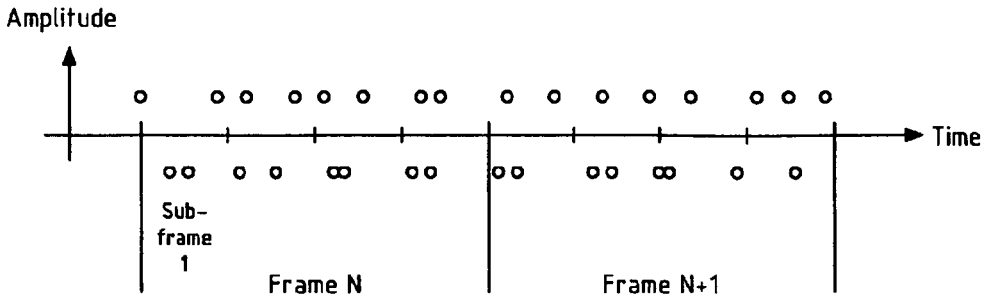
FIG. 4*a*: a schematic pulse excitation in time domain of codebook pulses.

FIG. 4*a* presents an example of a time domain residual coding with signed pulses. In this example, the fixed codebook contains four pulses per subframe, but the number of pulses may vary therefrom, e.g. depending on the applied codec or the applied mode of a codec.

According to the present invention, the at least one of said at least one time scaled coded domain parameter to be determined, i.e. the time scaled codebook codevector, is determined based on the coded codebook parameters depicted in FIG. 5*a*. Thus, the time scaling operation is performed in coded domain based on the pulse coded residual signal parameters of the fixed codebook.

Figure 4B:
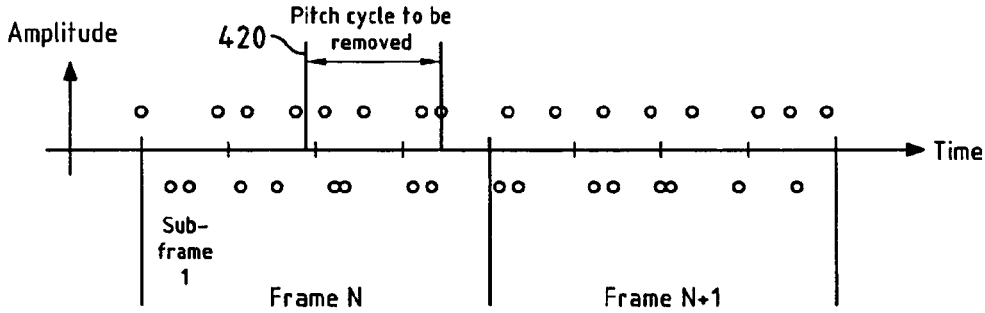
FIG. 4*b*: a schematic pitch cycle to be removed from the pulse excitation.

For instance, in case a negative time shift value is used for time scaling, then an associated time interval according to the time shift value is removed from the time domain pulse coded residual signal parameters, as exemplarily depicted in FIG. 4*b*, wherein a pitch cycle is indicated to be removed from frame N.

Figure 4C:
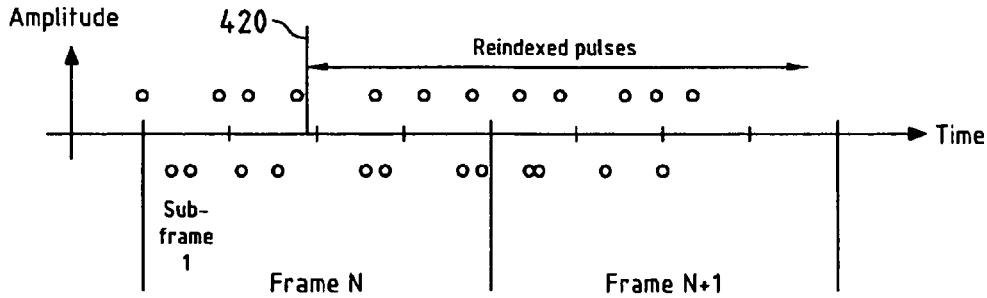
FIG. 4*c*: a schematic time scaled pulse excitation of codebook pulses according to an exemplary time scaling of the present invention in which a pitch cycle has been removed.

Accordingly, the pulse coded residual signal parameters within this time interval to be removed are cancelled, and the subsequent pulse coded residual signal parameters are shifted in negative direction, as exemplarily depicted in FIG. 4*c*.

Figure 4D:
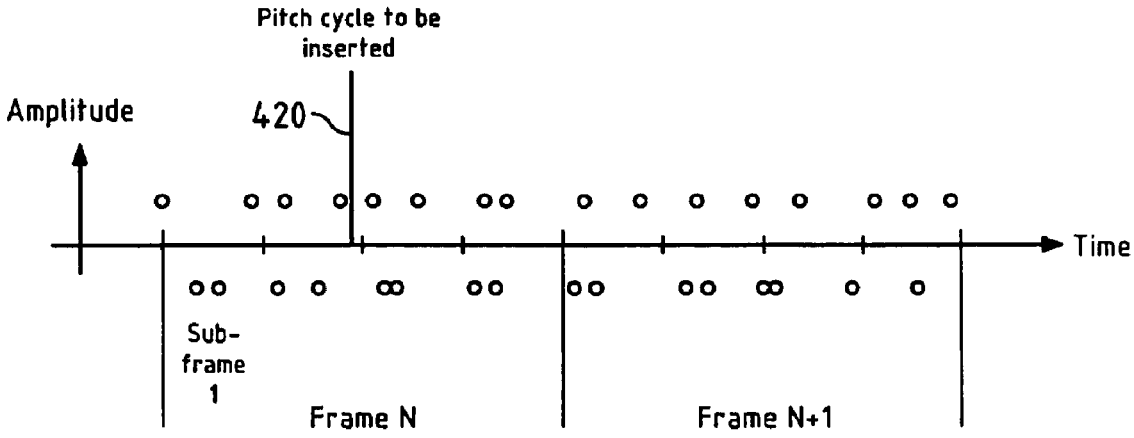
FIG. 4*d*: a schematic pitch cycle to be inserted the pulse excitation.
Figure 4E:
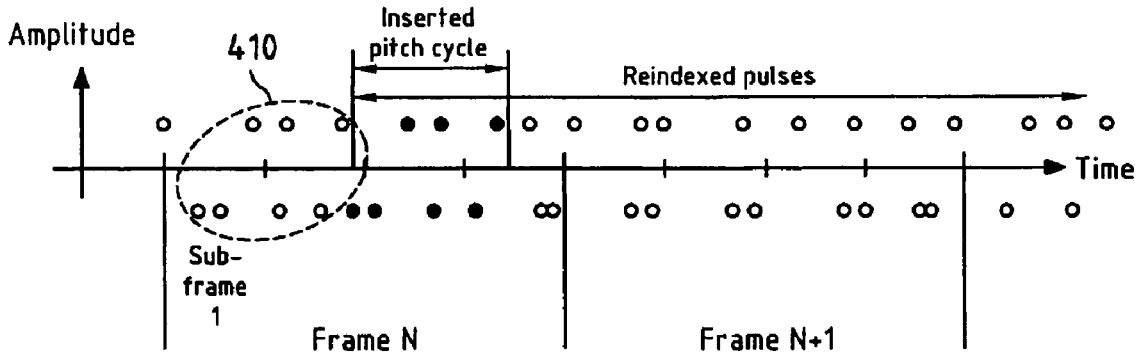
FIG. 4*e*: a schematic time scaled pulse excitation of codebook pulses according to an exemplary time scaling of the present invention in which a pitch cycle has been inserted.

On the other hand, in case a positive time shift value is used for time scaling, then an associated time interval according to the time shift value is inserted at the desired time point, as exemplarily depicted in FIG. 4*d*, wherein a pitch cycle is indicated to be inserted in frame N starting at discontinuation point 420. The pulse coded residual signal parameters subsequent to the insertion time point are shifted in positive direction according to the length of the time interval to be inserted, and the inserted time interval is filled with a copy of the preceding pulse coded residual signal parameters 410, as illustrated in FIG. 4*e*. This insertion may for instance be performed similar as an insertion of a cyclic prefix.

As depicted in FIGS. 4*c* and 4*e*, the pulse positions in the inserted time interval as well as the positions after the discontinuation point 420 need to be re-indexed in order to comply with the codebook structure of the AMR-WB fixed codebook.

For instance, Table 1 depicts potential positions of individual pulses in the algebraic codebook for modes of 8.85 to 23.85 kbit/s in AMR-WB codec, and Table 2 depicts potential positions of individual pulses in the algebraic codebook for mode 6.6 kbit/s in AMW-WB codec.

TABLE 1

Potential positions of individual pulses in the algebraic codebook for modes 8.85 to 23.85 kbit/s

| Track | Positions |
|---|---|
| 1 | 0, 4, 8, 12, 16, 20, 24, 28, 32 36, 40, 44, 48, 52, 56, 60 |
| 2 | 1, 5, 9, 13, 17, 21, 25, 29, 33, 37, 41, 45, 49, 53, 57, 61 |
| 3 | 2, 6, 10, 14, 18, 22, 26, 30, 34, 38, 42, 46, 50, 54, 58, 62 |

TABLE 1-continued

| Potential positions of individual pulses in the algebraic codebook for modes 8.85 to 23.85 kbit/s | |
|---|---|
| Track | Positions |
| 4 | 3, 7, 11, 15, 19, 23, 27, 31, 35, 39, 43, 47, 51, 55, 59, 63 |

TABLE 2

| Potential positions of individual pulses in the algebraic codebook for mode 6.6 kbit/s | |
|---|---|
| Track | Positions |
| 1 | 0, 2, 4, 6, 8, 10, 12, 14, 16, 18, 20, 22, 24, 26, 28, 30, 32, 34, 36, 38, 40, 42, 44, 46, 48, 50, 52, 54, 56, 58, 60, 62 |
| 2 | 1, 3, 5, 7, 9, 11, 13, 15, 17, 19, 21, 23, 25, 27, 29, 31, 33, 35, 37, 39, 41, 43, 45, 47, 49, 51, 53, 55, 57, 59, 61, 63 |

As can be seen in Table 1 and 2, the indexing of time scales pulses is not completely straightforward. First of all, the number of pulses per subframe may vary depending on the length of the time interval that is removed or inserted to a certain location. Furthermore, the new pulse positions may not fit properly on the track structure.

Figure 5:
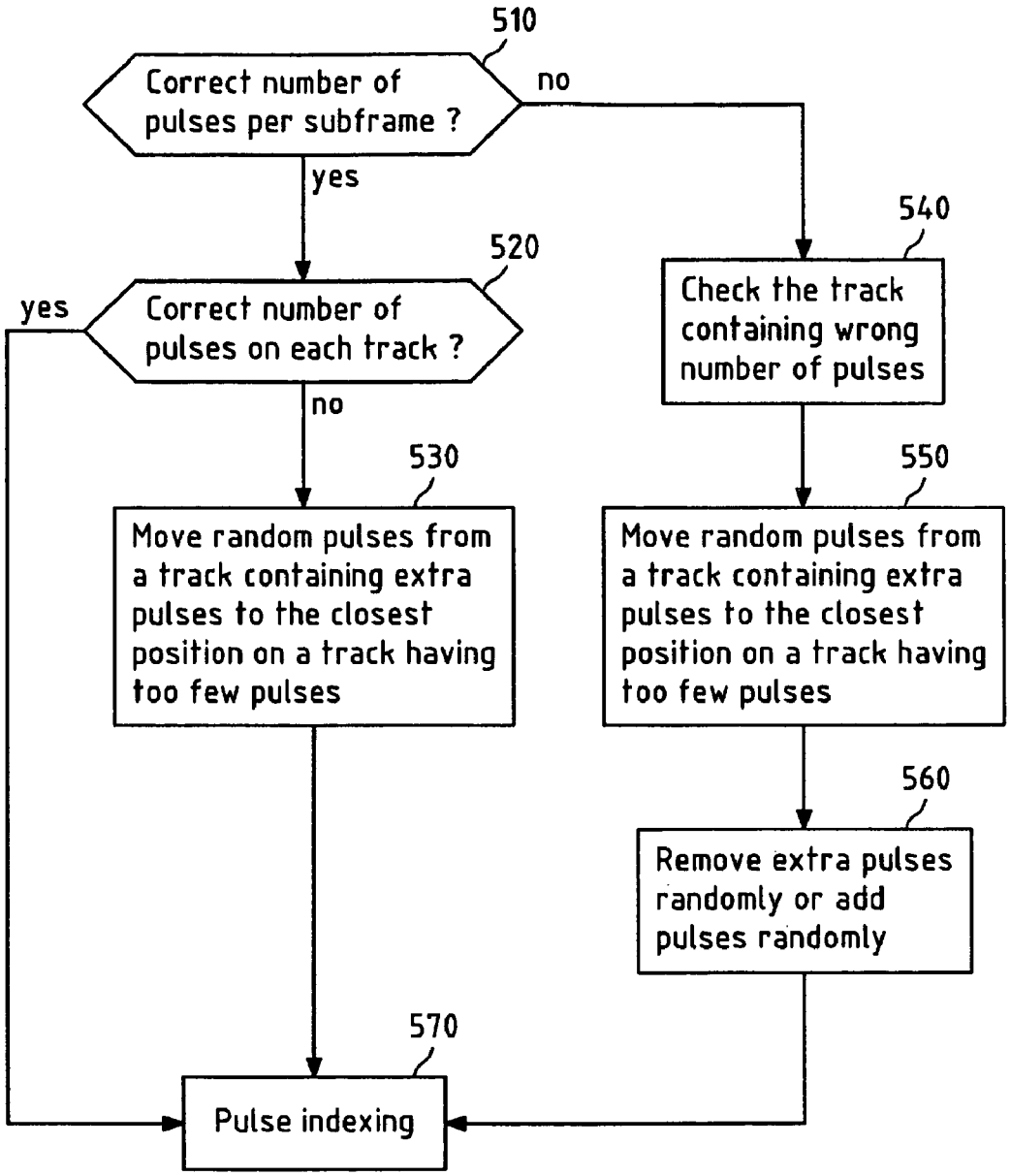
FIG. 5: a schematic a flowchart of an exemplary embodiment of a method according to the present invention for reindexing time-shifted codebook parameters.

An exemplary reindexing according to the present invention will be described in view of the exemplary method of reindexing depicted in the flow-chart on FIG. 5.

The indexing of new time scaled pulse excitation may be conducted by first checking 510 the number of pulses per subframe. If the number is correct, the next check 520 may be verifying that each track has correct number of pulses. In case both of these conditions match, the standard AMR-WB pulse position indexing is performed. If the pulses are not distributed on the tracks correctly, random pulses from a track having too many pulses may be moved to the closest position on a track lacking pulses (step 530).

If the number of pulses per subframe is not correct at check 510, then the track containing wrong number of pulses may be checked 540 and random pulses from a track having too many pulses may be moved to the closest position on a track lacking pulses (step 550). If then the track still contains wrong number of pulses, then extra pulses are removed randomly (step 560), and in case the number of pulses is not sufficient, then a random pulse or random pulses are added to the given track (step 560).

Figure 6:
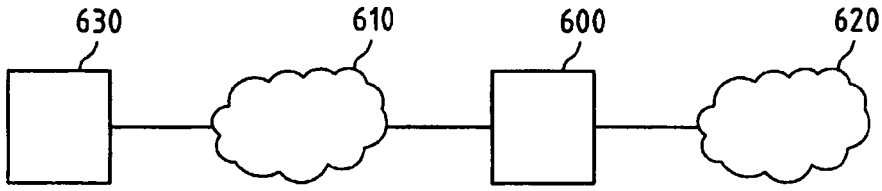
FIG. 6: a schematic block diagram of an exemplary embodiment of a system of the present invention.

FIG. 6 depicts a schematic block diagram of an exemplary embodiment of a system of the present invention. This exemplary system comprises a first network 610 adapted to transmit encoded audio/speech streams, a second network 620 adapted to transmit encoded audio/speech streams, a transmitter 630 configured to provide an encoded audio/speech stream for transmission via said first network, an apparatus 600 according to the present invention configured to receive said encoded audio/speech stream, to perform time scaling operation to said encoded audio/speech frame in said coded domain and to provide the encoded time scaled audio/speech frame for transmission via said second network.

This apparatus 600 may represent any exemplary embodiment of the apparatuses described above and may perform any of the exemplary embodiments of methods described above in order to perform time scaling in the coded domain.

For instance, said apparatus may represent a media gateway for connecting the first network 610 and the second network 620. The apparatus 600 may be used to perform a time scaling operation of a received encoded audio/speech stream. For instance, the apparatus 600 may comprise a buffer for storing received audio/speech frames waiting for further processing. Then, the time scaling in the coded domain may be used for buffering with adaptive jitter. According to the time shift value, the jitter buffer can be extended to handle the late packets or late frames in the media gateway, as depicted in FIG. 7 and described above. The coded parameters to be transmitted to the second network 620, which may also represent another transmission channel or a forward to playback device in a terminal) need to be extracted at regular interval from the corresponding evolution path.

The conducted time scaling may improve the situation compared to a fixed buffer as depicted in FIG. 1, since there is no need to drop late frames and conduct any frame error concealment, as can be seen from FIG. 7.

For instance, said system may comprise a network control unit configured to provide time alignment information to said apparatus in response to network characteristics of said first network.

This may improve to choose an appropriate time scale value in order to adapt the jitter buffer size accordingly.

It is readily clear for a skilled person that the logical blocks in the schematic block diagrams as well as the flowchart and algorithm steps presented in the above description may at least partially be implemented in electronic hardware and/or computer software, wherein it depends on the functionality of the logical block, flowchart step and algorithm step and on design constraints imposed on the respective devices to which degree a logical block, a flowchart step or algorithm step is implemented in hardware or software. The presented logical blocks, flowchart steps and algorithm steps may for instance be implemented in one or more digital signal processors, application specific integrated circuits, field programmable gate arrays or other programmable devices. Said computer software may be stored in a variety of storage media of electric, magnetic, electro-magnetic or optic type and may be read and executed by a processor, such as for instance a microprocessor. To this end, said processor and said storage medium may be coupled to interchange information, or the storage medium may be included in the processor.

The invention has been described above by means of exemplary embodiments. It should be noted that there are alternative ways and variations which are obvious to a skilled person in the art and can be implemented without deviating from the scope and spirit of the appended claims. In particular, the present invention is not limited to application in AMR-WB systems, but may also be applied to any other coded speech/audio stream or to any coded video stream.

What is claimed is:

1. A method, comprising:

extracting a coded parameter set from an encoded speech/audio stream, wherein said encoded speech/audio stream is distributed to a sequence of packets; and generating a time scaled encoded audio/speech stream in the parameter coded domain using said extracted coded parameter set, wherein said extracted coded parameter set comprises at least one coded parameter, and wherein said at least one coded parameter is associated with at least one point in time, and wherein the method further comprises:

determining at least one time scaled coded parameter based on said at least one coded parameter and on a time shift value, wherein this determining is performed in a coded domain;

wherein said at least one coded parameter represents at least one time-domain coded coefficient associated with at least one parameter type, and wherein at least one of said at least one coded parameters is associated with one single parameter type of said at least one parameter types, and wherein at least one of said at least one time scaled coded parameters associated with said one single parameter type is determined by means of at least one out of the following functions:

interpolation based on at least two of said at least one coded parameters associated with said one single parameter type, and extrapolation based on at least one of said at least one coded parameters associated with said one single parameter type; and wherein said at least one parameter type is at least one out of:

Linear Predictive Coding (LPC) filter parameter type;

pitch lag parameter type;

fixed codebook gain parameter type; and adaptive codebook gain parameter type.

2. The method according to claim 1, wherein said at least one of said at least one coded parameters represents a group of parameters forming a parameter evolution path, wherein said coded parameters in said parameter evolution path are associated with different points in time, and wherein in said parameter evolution path at least one of said at least one coded parameters is time-shifted according to said time shift value, and wherein said at least one time scaled coded parameter associated with said parameter type is determined on the basis of the corresponding shifted parameter evolution path.

3. The method according to claim 2, further comprising:

time shifting said shifted parameter evolution path by a second time shift value, wherein said second time shift value is determined on the basis of returning said shifted parameter evolution path to said parameter evolution path, and wherein at least one time scaled coded parameter is determined based on said parameter evolution path.

4. The method according to claim 2, further comprising:

applying said time shifting dependent on the result of a voiced/unvoiced speech region detector switch.

5. The method according to claim 2, wherein time scaling is performed at a discontinuation point, and wherein said at least one time-shifted parameter is the at least one coded parameter having its originally associated time position after said discontinuation point, and, in case that said time shift value represents a negative value, then time-shifted parameters shifted behind the discontinuation point are cancelled from said shifted parameter evolution path.

6. The method according to claim 5, wherein said at least one time scaled coded parameter associated with said parameter type is associated with at least one point in time of said different points in time after the discontinuation point, and wherein each of said at least one time scaled coded parameter is determined by means of one out of the following functions:

interpolation between the previous available parameter and the next available parameter of said time shifted parameter evolution path, and extrapolation based on at least one previous available parameter or on at least one next available parameter of said time shifted parameter evolution path.

7. The method according to claim 2, wherein one of said at least one parameter types represents a LPC filter parameter type, and wherein said at least one coded parameter represents at least one out of Immittance Spectral Pair (ISP) and Linear Spectrum Pair (LSP) parameters of corresponding LPC parameters, and wherein said different points in time are equally spaced and are associated with one out of:

a frame index associated with frames of said stream; or a subframe index associated with subframes of said stream.

8. The method according to claim 1, wherein a plurality of parameters of said coded parameter set represent codebook parameters associated with at least two subframes of said audio/speech stream, said codebook parameters representing coded time domain pulses, and wherein time scaling is performed at a discontinuation point, so that the coded time domain pulses after said discontinuation point are time shifted according to the time shift value, and, in case said time shift value represents a negative value, then time-shifted pulses shifted behind the discontinuation point are cancelled, and, in case said time shift value represents a positive value and thus a time interval is inserted at the discontinuation point, then this time interval is filled with a copy of preceding pulses.

9. The method according to claim 8, comprising a reindexing of said coded time domain pulses after time scaling based on a codebook position rule of the speech/audio codec.

10. A computer program product in which a software code is stored in a non-transitory computer readable medium, wherein said code causes the following when being executed by a processor:

extracting a coded parameter set from an encoded speech/audio stream, wherein said encoded speech/audio stream is distributed to a sequence of packets; and generating a time scaled encoded audio/speech stream in the parameter coded domain using said extracted coded parameter set, wherein said extracted coded parameter set comprises at least one coded parameter, and wherein said at least one coded parameter is associated with at least one point in time, and wherein the computer program product comprises code operable to cause a processor to determine at least one time scaled coded parameter based on said at least one coded parameter and on a time shift value, wherein this determining is performed in a coded domain;

wherein said at least one coded parameter represents at least one time-domain coded coefficient associated with at least one parameter type, and wherein at least one of said at least one coded parameter is associated with one single parameter type of said at least one parameter type, and wherein at least one of said at least one time scaled coded parameters associated with said one single parameter type is determined by means of at least one out of the following functions:

interpolation based on at least two of said at least one coded parameters associated with said one single parameter type, and extrapolation based on at least one of said at least one coded parameters associated with said one single parameter type; and wherein said at least one parameter type is at least one out of:

Linear Predictive Coding (LPC) filter parameter type;

pitch lag parameter type;

fixed codebook gain parameter type; and adaptive codebook gain parameter type.

11. An apparatus, comprising a computer readable memory; and a processor, said processor being configured to:

extract a coded parameter set from an encoded speech/audio stream, wherein said encoded speech/audio stream being is distributed to a sequence of packets; and generate a time sc-a4*e* scaled encoded audio/speech stream in the parameter coded domain using said extracted coded parameter set, wherein said extracted coded parameter set comprises at least one coded parameter, and wherein said at least one coded parameter is associated with at least one point in time, and wherein said processor is configured to determine at least one time scaled coded parameter based on said at least one coded parameter and on a time shift value, wherein this determining is performed in a coded domain;

wherein said at least one coded parameter represents at least one time-domain coded coefficient associated with at least one parameter type, and wherein at least one of said at least one coded parameters is associated with one single parameter type of said at least one parameter types, and wherein at least one of said at least one time scaled coded parameters associated with said one single parameter type is determined by means of at least one out of the following functions:

interpolation based on at least two of said at least one coded parameters associated with said one single parameter type, and extrapolation based on at least one of said at least one coded parameters associated with said one single parameter type; and wherein said at least one parameter type is at least one out of:

Linear Predictive Coding (LPC) filter parameter type; pitch lag parameter type;

fixed codebook gain parameter type; and adaptive codebook gain parameter type.

12. The apparatus according to claim 11, wherein said at least one of said at least one coded parameters represents a group of parameters forming a parameter evolution path, wherein said coded parameters in said parameter evolution path are associated with different points in time, and wherein in said parameter evolution path at least one of said at least one coded parameters is time-shifted according to said time shift value, and wherein said at least one time scaled coded parameter associated with said parameter type is determined on the basis on the corresponding shifted parameter evolution path.

13. The apparatus according to claim 12, wherein the processor is further configured to time shift said shifted parameter evolution path by a second time shift value, wherein said second time shift value is determined on the basis of returning said shifted parameter evolution path to said parameter evolution path, and wherein at least one time scaled coded parameter is determined based on said parameter evolution path.

14. The apparatus according to claim 12, wherein the processor is further configured to apply said time shifting dependent on the result of a voiced/unvoiced speech region detector switch.

15. The apparatus according to claim 12, wherein time scaling is performed at a discontinuation point, and wherein said at least one time-shifted parameter is the at least one coded parameter having its originally associated time position after said discontinuation point, and, in case that said time shift value represents a negative value, then time-shifted parameters shifted behind the discontinuation point are cancelled from said shifted parameter evolution path.

16. The apparatus according to claim 15, wherein said at least one time scaled coded parameter associated with said parameter type is associated with at least one point in time of said different points in time after the discontinuation point, and wherein at least one of said at least one time scaled coded parameters is determined by means of at least one out of the following functions:

interpolation between the previous available parameter and the next available parameter of said time shifted parameter evolution path, and extrapolation between based on at least one previous available parameter or on at least one next available parameter of said time shifted parameter evolution path.

17. The apparatus according to claim 12, wherein one of said at least one parameter types represents a LPC filter parameter type, and wherein said at least one coded parameter represents at least one out of Immittance Spectral Pair (ISP) and Linear Spectrum Pair (LSP) parameters of corresponding LPC parameters, and wherein said different point in times are equally spaced and are associated with one out of:

a frame index associated with frames of said stream; or a subframe index associated with subframes of said stream.

18. The apparatus according to claim 11, wherein a plurality of parameters of said coded parameter set represent codebook parameters associated with at least two subframes of said audio/speech stream, said codebook parameters representing coded time domain pulses, said processor being configured to perform time scaling at a discontinuation point, so that the coded time domain pulses after said discontinuation point are time shifted according to the time shift value, and, in case said time shift value represents a negative value, then time-shifted pulses shifted behind the discontinuation point are cancelled, and, in case said time shift value represents a positive value and thus a time interval is inserted at the discontinuation point, then this time interval is filled with a copy of preceding pulses.

19. The apparatus according to claim 18, said processor being configured to perform reindexing of said coded time domain pulses based on a codebook position rule of the speech/audio codec after said time scaling.

* * * * *